US008820471B2

(12) United States Patent
Shiozawa et al.

(10) Patent No.: US 8,820,471 B2
(45) Date of Patent: Sep. 2, 2014

(54) SPEAKER

(71) Applicant: Yamaha Corporation, Hamamatsu (JP)

(72) Inventors: Yasuo Shiozawa, Hamamatsu (JP); Koji Okazaki, Hamamatsu (JP); Ryo Hadano, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/712,251

(22) Filed: Dec. 12, 2012

(65) Prior Publication Data

US 2013/0146389 A1 Jun. 13, 2013

(30) Foreign Application Priority Data

Dec. 13, 2011 (JP) ..... 2011-272601

(51) Int. Cl.
*H04R 1/02* (2006.01)
*H04R 1/28* (2006.01)

(52) U.S. Cl.
USPC ..... 181/175; 181/199

(58) Field of Classification Search
USPC ..... 181/148, 155, 156, 199
See application file for complete search history.

(56) References Cited

U.S. PATENT DOCUMENTS

| | | | | | |
|---|---|---|---|---|---|
| 1,839,714 | A | * | 1/1932 | Tauscher et al. | 181/155 |
| 2,915,134 | A | * | 12/1959 | Braund | 181/156 |
| 2,982,372 | A | * | 5/1961 | Lowell | 181/155 |
| 3,263,769 | A | * | 8/1966 | Mercurius | 181/155 |
| 3,696,886 | A | * | 10/1972 | Armstrong | 181/156 |
| 3,746,125 | A | * | 7/1973 | Hammes | 181/199 |
| 3,964,571 | A | * | 6/1976 | Snell | 181/150 |
| 4,176,730 | A | * | 12/1979 | Mushkin | 181/148 |
| 4,201,274 | A | * | 5/1980 | Carlton | 181/156 |
| 4,301,889 | A | * | 11/1981 | Tralonga | 181/145 |
| 4,437,541 | A | | 3/1984 | Cross | |
| 4,509,192 | A | * | 4/1985 | Straughn | 381/348 |
| 5,004,066 | A | * | 4/1991 | Furukawa | 381/96 |
| 5,659,155 | A | * | 8/1997 | Porzilli | 181/0.5 |
| 6,226,927 | B1 | * | 5/2001 | Bertolini et al. | 49/502 |
| D465,211 | S | * | 11/2002 | Lawrence | D14/214 |
| D531,166 | S | * | 10/2006 | Baird | D14/207 |
| 7,481,295 | B2 | * | 1/2009 | Noro et al. | 181/156 |
| 2001/0037910 | A1 | * | 11/2001 | Coffin | 181/199 |
| 2004/0134711 | A1 | * | 7/2004 | Yoshimi et al. | 181/207 |
| 2007/0081687 | A1 | * | 4/2007 | Hayashi | 381/345 |
| 2007/0291965 | A1 | * | 12/2007 | Noro et al. | 381/182 |

FOREIGN PATENT DOCUMENTS

| | | | |
|---|---|---|---|
| CN | 102098599 | | 6/2011 |
| JP | 2000-115878 | A | 4/2000 |
| JP | 3115180 | B2 | 12/2000 |
| JP | 2009-94706 | A | 4/2009 |

OTHER PUBLICATIONS

European Search Report dated Jul. 7, 2014.

* cited by examiner

*Primary Examiner* — Jeremy Luks
(74) *Attorney, Agent, or Firm* — Crowell & Moring LLP

(57) ABSTRACT

A speaker, including: a casing having a baffle plate; and a sound source fixed to the baffle plate of the casing, wherein at least one cutout is formed in the baffle plate, the at least one cutout having a configuration in which a width of the at least one cutout increases with an increase in a distance from the sound source.

3 Claims, 18 Drawing Sheets

SPEAKER

CROSS REFERENCE TO RELATED APPLICATION

The present application claims priority from Japanese Patent Application No. 2011-272601, which was filed on Dec. 13, 2011, the disclosure of which is herein incorporated by reference in its entirety.

BACKGROUND OF THE INVENTION

1. Field of the Invention

The present invention relates to a technique for making acoustic characteristics of a speaker appropriate.

2. Description of Related Art

There is known a speaker having: an enclosure in the form of a box-like member; and one or a plurality of speaker units each of which is fixed to a plate of the enclosure that forms a front face of the enclosure, such that a sound emission surface of each speaker unit is oriented frontward of the speaker. The plate of the speaker to which each speaker unit is fixed is called a baffle plate. In such a speaker, sounds emitted in a frontward direction from each speaker unit are diffracted, and the diffracted sounds are reflected at various points on the baffle plate, so that the sounds reflected at various points are again emitted in the frontward direction. Consequently, there are transmitted, to listening points located frontward of the speaker, not only direct sounds emitted from the speaker units, but also the sounds diffracted after emission from the speaker units in the frontward direction and again emitted after reflection at various points on the baffle plate. Accordingly, peaks and dips occur in a frequency response of each of acoustic transmission systems from the speaker units to the listening points, undesirably causing a risk of deterioration in acoustic characteristics. In an attempt to solve the problem, the following Patent Literature 1 discloses a speaker system in which a sound absorbing member is attached to the periphery of a speaker unit on a front-face baffle of an enclosure. In the disclosed speaker system, sound waves diffracted sideways from the speaker unit are absorbed by the sound absorbing member on the front-face baffle, whereby the sound pressure of the sounds reflected in the frontward direction is reduced. According to the disclosed technique, acoustic characteristics at listening points located frontward of the speaker system can be prevented from being deteriorated.

Patent Literature 1: JP-A-2009-94706

SUMMARY OF THE INVENTION

In the technique disclosed in the above Patent Literature 1, however, since the sound absorbing member needs to be attached to the periphery of the speaker unit, the cost of manufacturing the speaker system is inevitably increased. The present invention has been developed in view of the situations. It is therefore an object of the invention to provide a technique to reduce deterioration in acoustic characteristics due to an influence of sounds reflected on a baffle plate of a speaker.

The object indicated above may be achieved according to one aspect of the invention, which provides a speaker, comprising:

a casing having a baffle plate; and a sound source fixed to the baffle plate of the casing, wherein at least one cutout is formed in the baffle plate, the at least one cutout having a configuration in which a width of the at least one cutout increases with an increase in a distance from the sound source.

The object indicated above may be achieved according to another aspect of the invention, which provides a speaker, comprising:

a casing having a baffle plate; and a sound source fixed to the baffle plate of the casing, wherein a first region and a second region having mutually different reflection characteristics are formed on the baffle plate, wherein the sound source is disposed in the first region, and wherein the second region has a width that increases with an increase in a distance from the sound source.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

Figure 11:
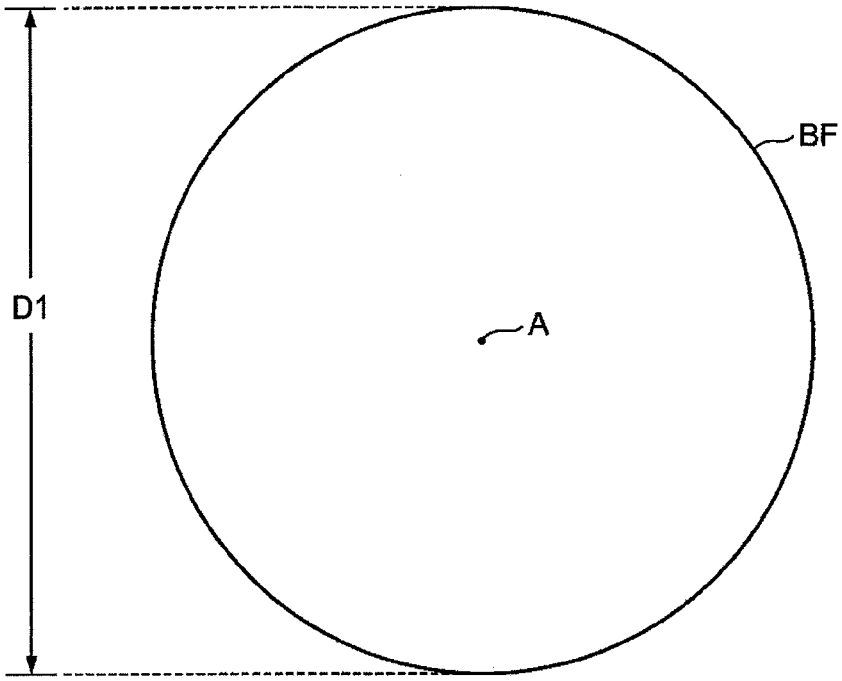
FIG. 11 is a view showing a baffle surface BF employed in an examination conducted by the inventors of the present invention.
Figure 12:
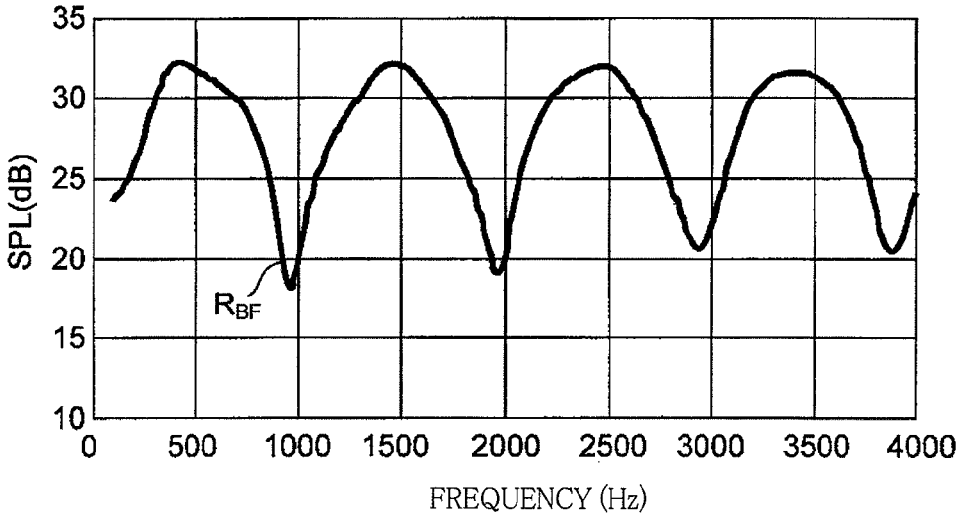
FIG. 12 is a graph showing a frequency response at a listening point on the baffle surface BF.

Embodiments described later are made on the basis of the following examinations conducted by the inventors of the present invention. As a model for analyzing physical phenomena on a baffle plate in an instance where sounds are emitted from a speaker, the inventors employed a baffle surface BF having a perfect circular shape with a diameter D1 (D1=610 mm), as shown in FIG. 11. There was calculated a frequency response $R_{BF}$ in an acoustic transmission system from an emission point of the sounds which is a center A of the baffle surface BF to a listening point Z1 which is distant from the emission point A in a frontward direction by a distance of 1000 mm. FIG. 12 is a graph showing the frequency response $R_{BF}$. In the frequency response $R_{BF}$, peaks appear at frequencies about 430 Hz, 1400 Hz, 2400 Hz, and 3390 Hz while dips appear at frequencies about 960 Hz, 1900 Hz, 2900 Hz, and 3890 Hz.

Figure 13:
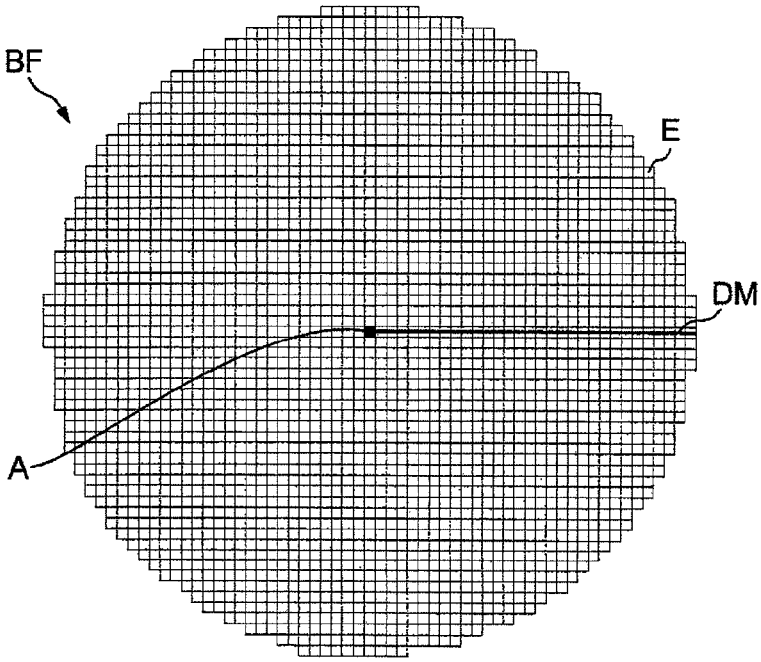
FIG. 13 is a view showing elements E which are obtained by dividing the baffle surface BF.

In order to examine the cause of the occurrence of the peaks and the dips in the frequency response $R_{BF}$, the inventors considered quantifying, by a boundary element method, a sound pressure to be generated at the listening point Z1 by sounds reflected at points on the baffle surface BF in an instance where there are emitted, from the emission point A, sounds at frequencies corresponding to the dips in the frequency response $R_{BF}$ and sounds at frequencies corresponding to the peaks in the frequency response $R_{BF}$. (Hereinafter, the frequency corresponding to the dip is referred to as the "dip frequency" and the frequency corresponding to the peak is referred to as the "peak frequency" where appropriate.) That is, as shown in FIG. 13, each of rectangular regions which are obtained by dividing the baffle surface BF into lattice is dealt with as an element E in the boundary element method, and a sound pressure P(q) at the listening point Z1 is calculated according to the following formula (1):

$$P(q) = \sum\left[\int \frac{dG(p,q)}{dn} dS \cdot P(p)\right] + j\omega\rho \sum\left[\int G(p,q) dS \cdot V(p)\right] \quad (1)$$

In the above formula (1), "p" represents a position vector at the center of the element E, "q" represents a position vector of the listening point Z1, "P(p)" represents a sound pressure at the element E, "V" represents a particle velocity, "S" represents an area of the element E, and "G(p, q)" is a Green function. This "G(p, q)" is given by the following formula (2). Further, "dG(p, q)/dn" is a derivative of the element E of the Green function G(p, q) in the normal direction.

$$G(p,q) = \frac{1}{4\pi r} e^{j(-kr+\phi)} \quad (2)$$

In the above formula (2), "r" represents a distance between the position vector p of the element E and the position vector q of the listening point Z1.

Figure 14A:
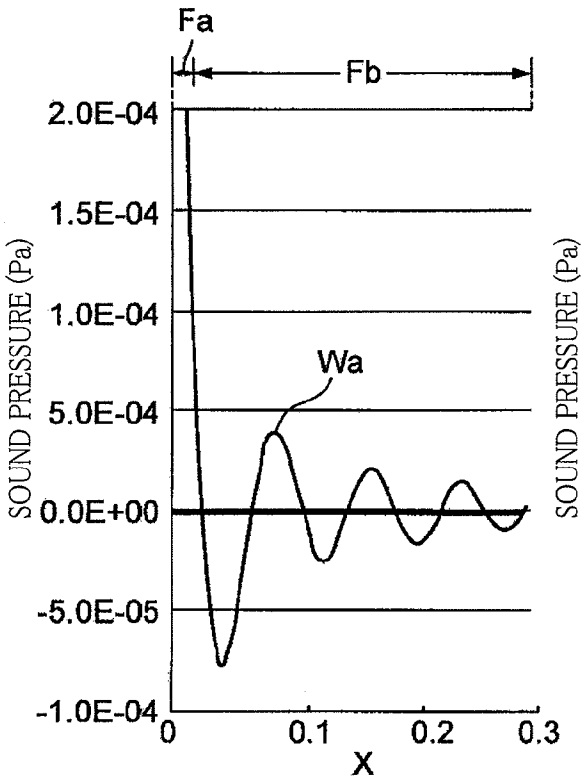
FIGS. 14A-14C are waveform diagrams made in the examination by the inventors of the present invention.
Figure 14B:
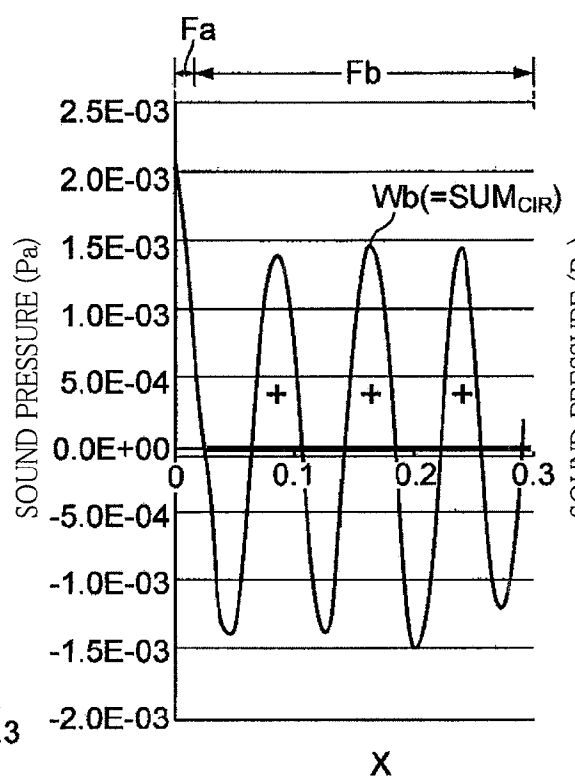
Figure 14C:
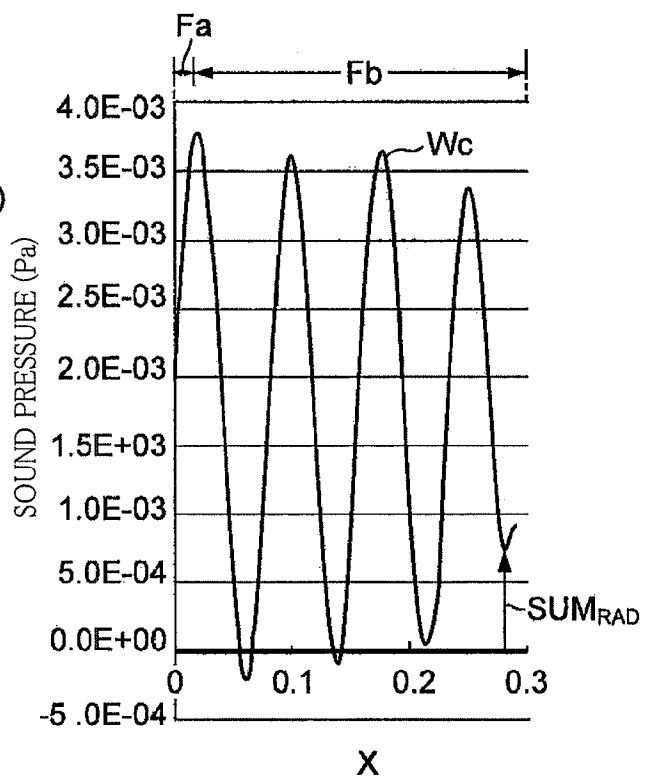
Figure 15A:
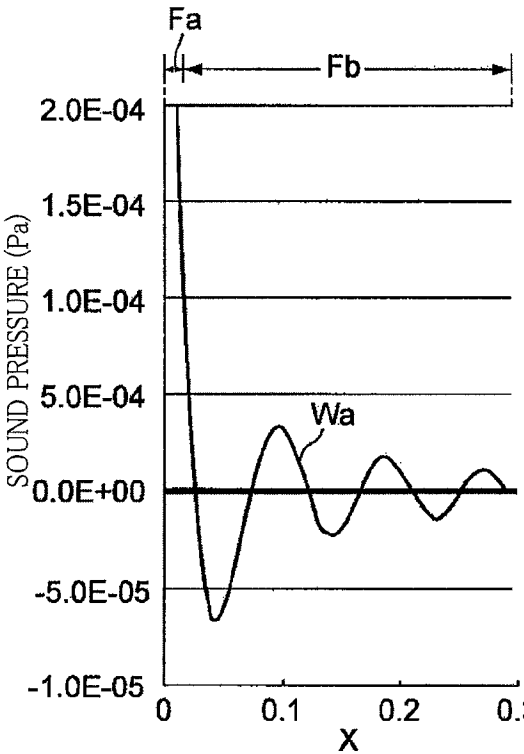
FIGS. 15A-15C are waveform diagrams made in the examination by the inventors of the present invention.

However, if the sound pressure P(q) generated at the listening point Z1 is calculated according to the above formula (1), an enormous amount of calculation is required. Accordingly, the inventors obtained the sound pressure P(q) generated at the listening point Z1 in the following manner. Initially, the inventors obtained sound pressures of reflected sounds at points on a straight line DM extending from the center A of the baffle surface BF to the outer circumference thereof. The waveform Wa shown in FIG. 14A indicates the sound pressure of the reflected sound at each point on the straight line DM when the sounds at the dip frequency (the sounds at 3890 Hz) were emitted from the center A of the baffle surface BF. The waveform Wa shown in FIG. 15A indicates the sound pressure of the reflected sound at each point on the straight line DM when the sounds at the peak frequency (the sounds at 3390 Hz) were emitted from the center A of the baffle surface BF. In FIGS. 14A and 15A, the horizontal axis x indicates the straight line DM, and an x coordinate value of the center A of the baffle surface BF is 0. In FIGS. 14A and 15A, the vertical axis indicates the sound pressure. This is true of FIGS. 14B, 15B, 14C, and 15C later explained.

Figure 15B:
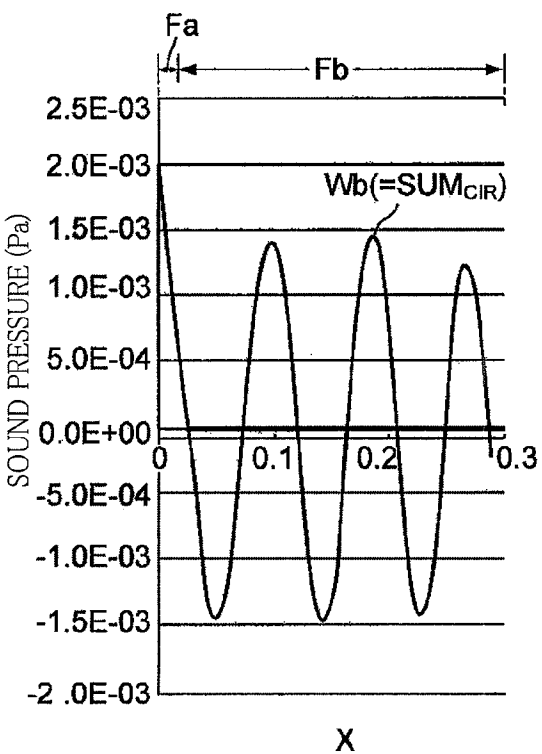
Figure 15C:
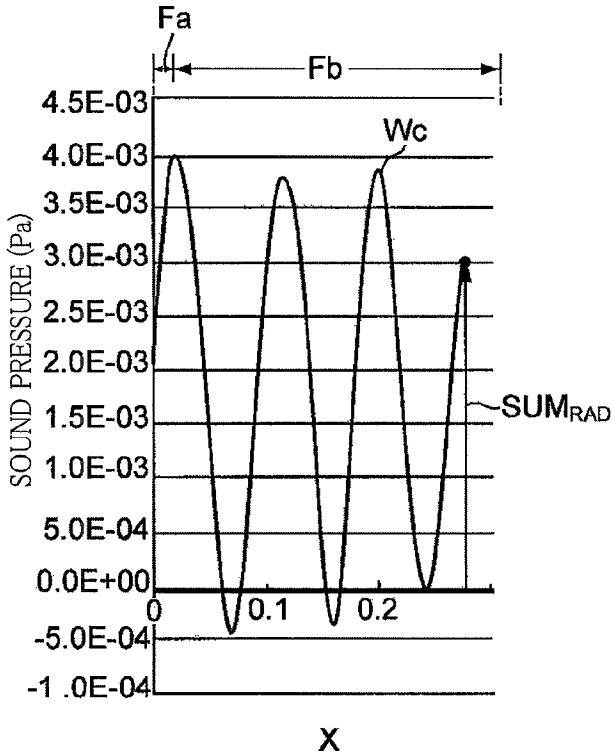

Next, focusing on the fact that the sound pressures of the diffracted sounds that reach points which are distant from the center A of the baffle surface BF by the same distance are substantially the same, the inventors calculated sound pressures by multiplying the sound pressures corresponding to the respective x coordinate values in each of FIGS. 14A and 15A, by 2πx. The sound pressure (waveform Wb) shown in each of FIGS. 14B and 15B indicates the sound pressures obtained after multiplying by 2πx. In FIGS. 14B and 15B, the sound pressure corresponding to each of the x coordinate values indicates a total sum $SUM_{CIR}$ which is a sum of the sound pressures of the reflected sounds generated at points on the circumference of a circle whose center coincides with the center A of the baffle surface BF and which has a radius x. The sound pressure at the listening point Z1 generated by all of the reflected sounds generated on the baffle surface BF depends on a value obtained by adding up the total sums $SUM_{CIR}$ obtained for respective positions, i.e., respective x coordinate values, on the straight line DM from the center A of the baffle surface BF to the end thereof, each total sum $SUM_{CIR}$ being a sum of the sound pressures of all of the reflected sounds generated on the circumferential of the circle having the radius x. In other words, the sound pressure at the listening point Z1 depends on an integrated value $SUM_{RAD}$ obtained by integrating the sound pressure $SUM_{CIR}$ in a direction from the center A of the baffle surface BF to the end thereof. The waveform We shown in each of FIGS. 14C and 15C indicates a relationship between the x coordinate value and the integrated value of the sound pressures $SUM_{CIR}$ from x=0 to each x coordinate value.

The inventors confirmed, for the waveform Wb of the integrated value $SUM_{CIR}$ shown in each of FIGS. 14 and 15B, characteristics common to both of the sounds at the dip frequency and the sounds at the peak frequency, characteristics common only to the sounds at the dip frequency, and characteristics common only to the sounds at the peak frequency.

a1. Characteristics Common to Both of the Sounds at the Dip Frequency and the Sounds at the Peak Frequency The amplitude at the center A of the baffle surface BF is maximum.

The amplitude at the periphery of the baffle surface BF is 0.

The amplitude is reduced from the maximum value to 0 in a section Fa between: the center A of the baffle surface BF; and a point which is distant from the center A toward the periphery of the baffle surface BF by a distance corresponding to a quarter of the wavelength of the corresponding sounds.

In a section Fb between: the point which is distant from the center A toward the periphery of the baffle surface BF by the distance corresponding to the quarter of the wavelength; and the periphery of the baffle surface BF, a positive peak and a negative peak having respective amplitudes whose absolute values are substantially the same alternately appear with an interval corresponding to a half of the wavelength of the corresponding sounds.

b1. Characteristics Common Only to the Sounds at the Dip Frequency

In the section Fb, the number of appearances of the negative peaks is larger than the number of appearances of the positive peaks by one.

c1. Characteristics Common Only to the Sounds at the Peak Frequency

In the section Fb, the number of appearances of the positive peaks and the number of appearances of the negative peaks are the same.

The inventors estimated from the above characteristic a1, b1, and c1 that the following physical phenomena occurred at the listening point Z1 when the sounds at the dip frequency and the sounds at the peak frequency were emitted from the sound source of the speaker.

a2. Case in which the Sounds at the Dip Frequency were Emitted

Figure 16:
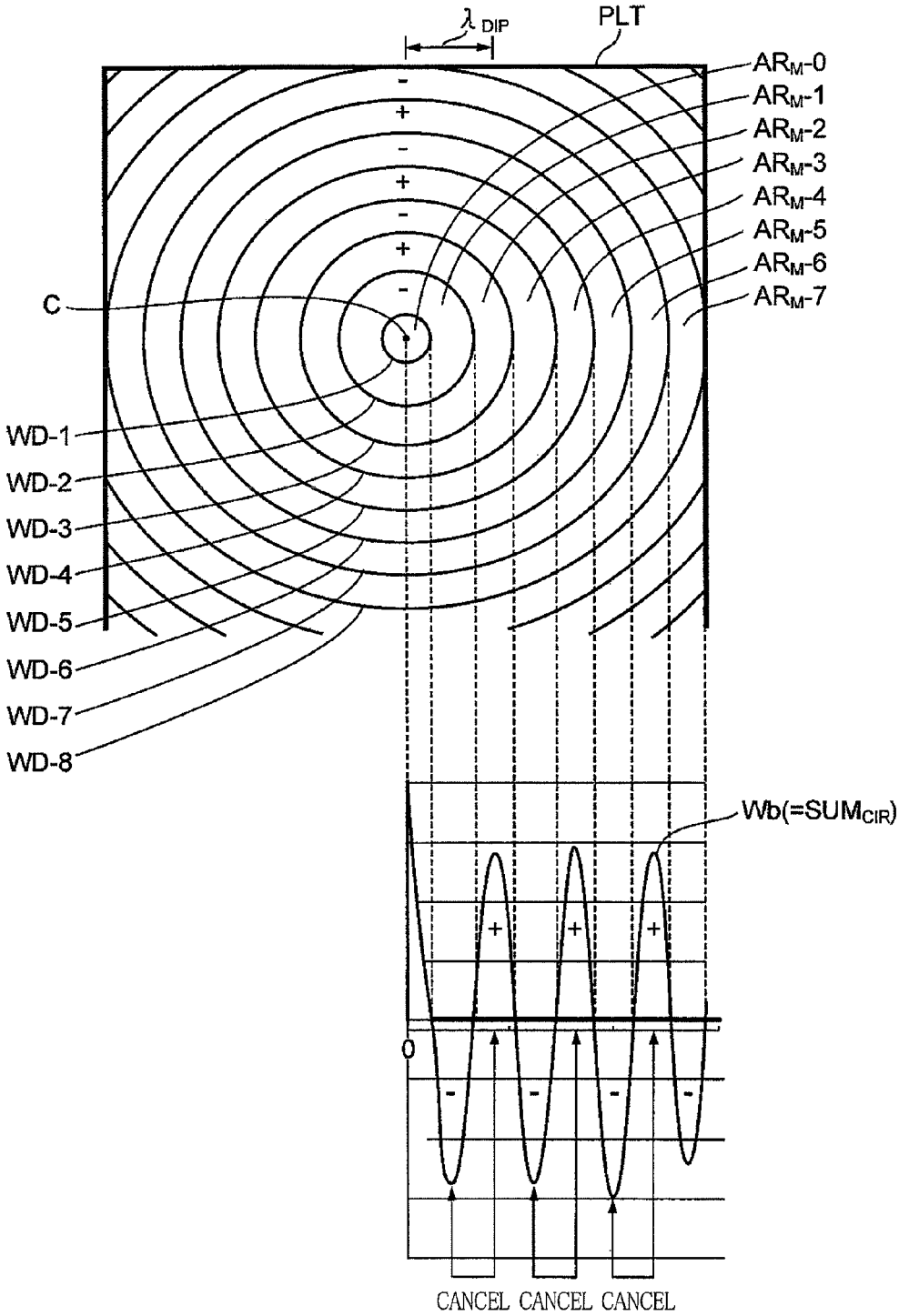
FIG. 16 is a view for explaining physical phenomena on the baffle surface.

As shown in FIG. 16, one wavelength of the sounds at the dip frequency is represented as $\lambda_{DIP}$, and concentric circles WD-m (m=1~8) are illustrated on the baffle plate PLT of the speaker, such that each concentric circle is distant from the sound source C by a distance of $\lambda_{DIP}/4+\lambda_{DIP}/2\times(m-1)$, wherein m=1~M, and "M" is the number of zero crossing points in the waveform Wb (M=8 in FIG. 16). In FIG. 16, where annular regions defined between circle WD-1 and circle WD-2, circle WD-2 and circle WD-3, circle WD-3 and circle WD-4, circle WD-4 and circle WD-5, circle W-5 and circle WD-6, circle WD-6 and circle WD-7, and circle WD-7 and circle WD-8 are respectively defined as regions $AR_M$-1~$AR_M$-7, absolute values $|SUM_{CIR}|$ of the total sums $SUM_{CIR}$ of the reflected sounds emitted from the respective regions $AR_M$-1~$AR_M$-7 are substantially the same. Accordingly, in this case, the negative sound pressure of the reflected sounds emitted from the region $AR_M$-1 and the positive sound pressure of the reflected sounds emitted from the region $AR_M$-2 are canceled at the listening point Z1. The negative sound pressure of the reflected sounds emitted from the region $AR_M$-3 and the positive sound pressure of the reflected sounds emitted from the region $AR_M$-4 are canceled at the listening point Z1. The negative sound pressure of the reflected sounds emitted from the region $AR_M$-5 and the positive sound pressure of the reflected sounds emitted from the region $AR_M$-6 are canceled at the listening point Z1. In this case, therefore, the sound pressure acts on the listening point Z1 which is a sum of the positive sound pressure of the direct sounds and the reflected sounds emitted from the region $AR_M$-0 located inward of the region $AR_M$-1 and the negative sound pressure of the reflected sounds emitted from the region $AR_M$-7 located near the peripheral end of the baffle plate PLT. As a result, the sound pressure at the listening point Z1 is minimum (dip).

b2. Case in which the Sounds at the Peak Frequency were Emitted

Figure 17:
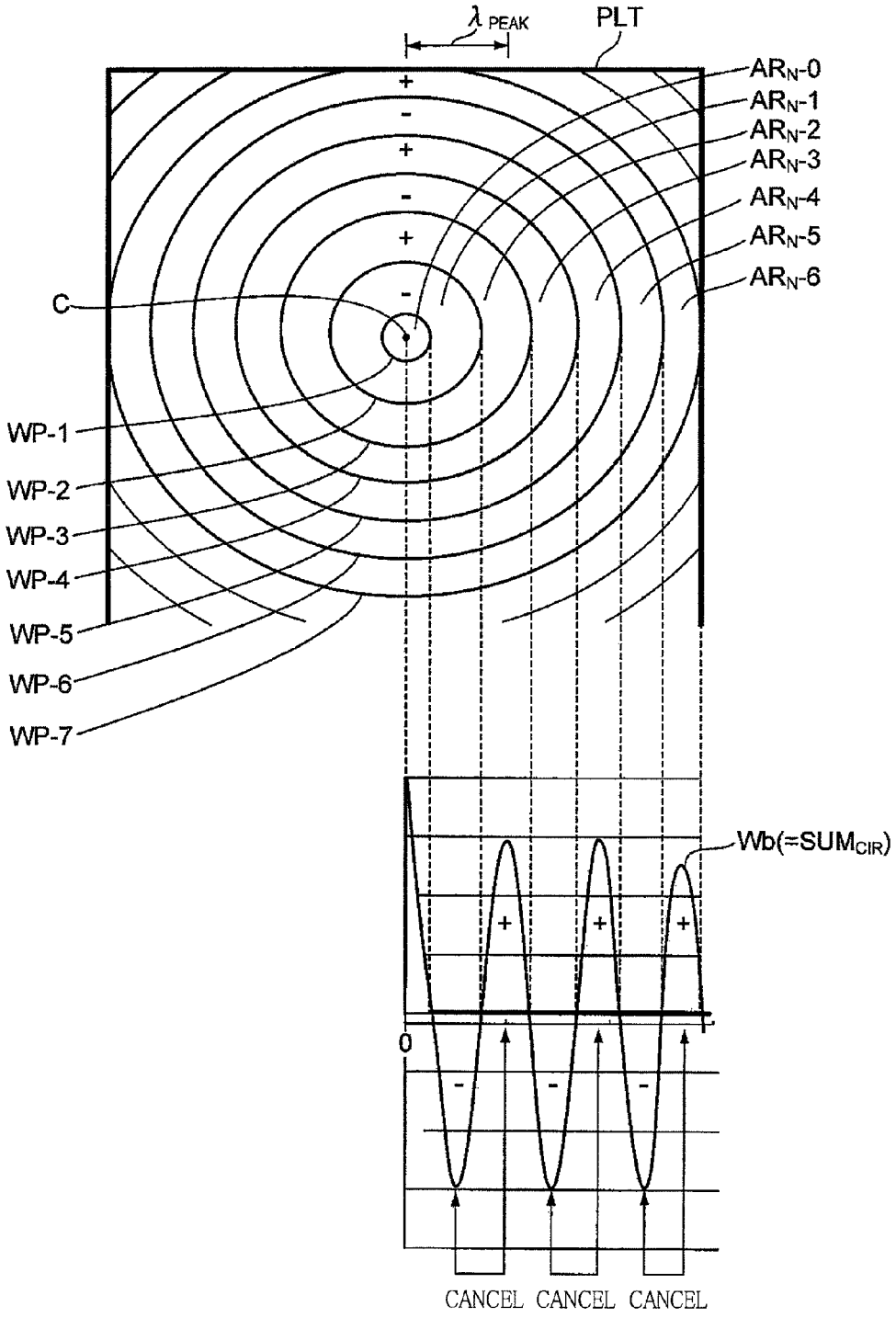
FIG. 17 is a view for explaining physical phenomena on the baffle surface.

As shown in FIG. 17, one wavelength of the sounds at the peak frequency is represented as $\lambda_{PEAK}$, and concentric circles WP-n (n=1~7) are illustrated on the baffle plate PLT of the speaker, such that each concentric circle is distant from the sound source C by a distance of $\lambda_{PEAK}/4+\lambda_{PEAK}/2\times(n-1)$, wherein n=1~N, and "N" is the number of zero crossing points in the waveform Wb (N=7 in FIG. 17). In FIG. 17, where annular regions defined between circle WP-1 and circle WP-2, circle WP-2 and circle WP-3, circle WP-3 and circle WP-4, circle WP-4 and circle WP-5, circle WP-5 and circle WP-6, and circle WP-6 and circle WP-7 are respectively defined as regions $AR_N$-1~$AR_N$-6, absolute values $|SUM_{CIR}|$ of the total sums $SUM_{CIR}$ of the reflected sounds emitted from the respective regions $AR_N$-1~$AR_N$-6 are substantially the same. Accordingly, in this case, the negative sound pressure of the reflected sounds emitted from the region $AR_N$-1 and the positive sound pressure of the reflected sounds emitted from the region $AR_N$-2 are canceled at the listening point Z1. The negative sound pressure of the reflected sound emitted from the region $AR_N$-3 and the positive sound pressure of the reflected sounds emitted from the region $AR_N$-4 are canceled at the listening point Z1. The negative sound pressure of the reflected sounds emitted from the region $AR_N$-5 and the positive sound pressure of the reflected sounds emitted from the region $AR_N$-6 are canceled at the listening point Z1. In this case, therefore, only the positive sound pressure of the direct sounds and the reflected sounds emitted from the region $AR_N$-0 located inward of the region $AR_N$-1 acts on the listening point Z1. As a result, the sound pressure at the listening point Z1 is maximum (peak).

Figure 18:
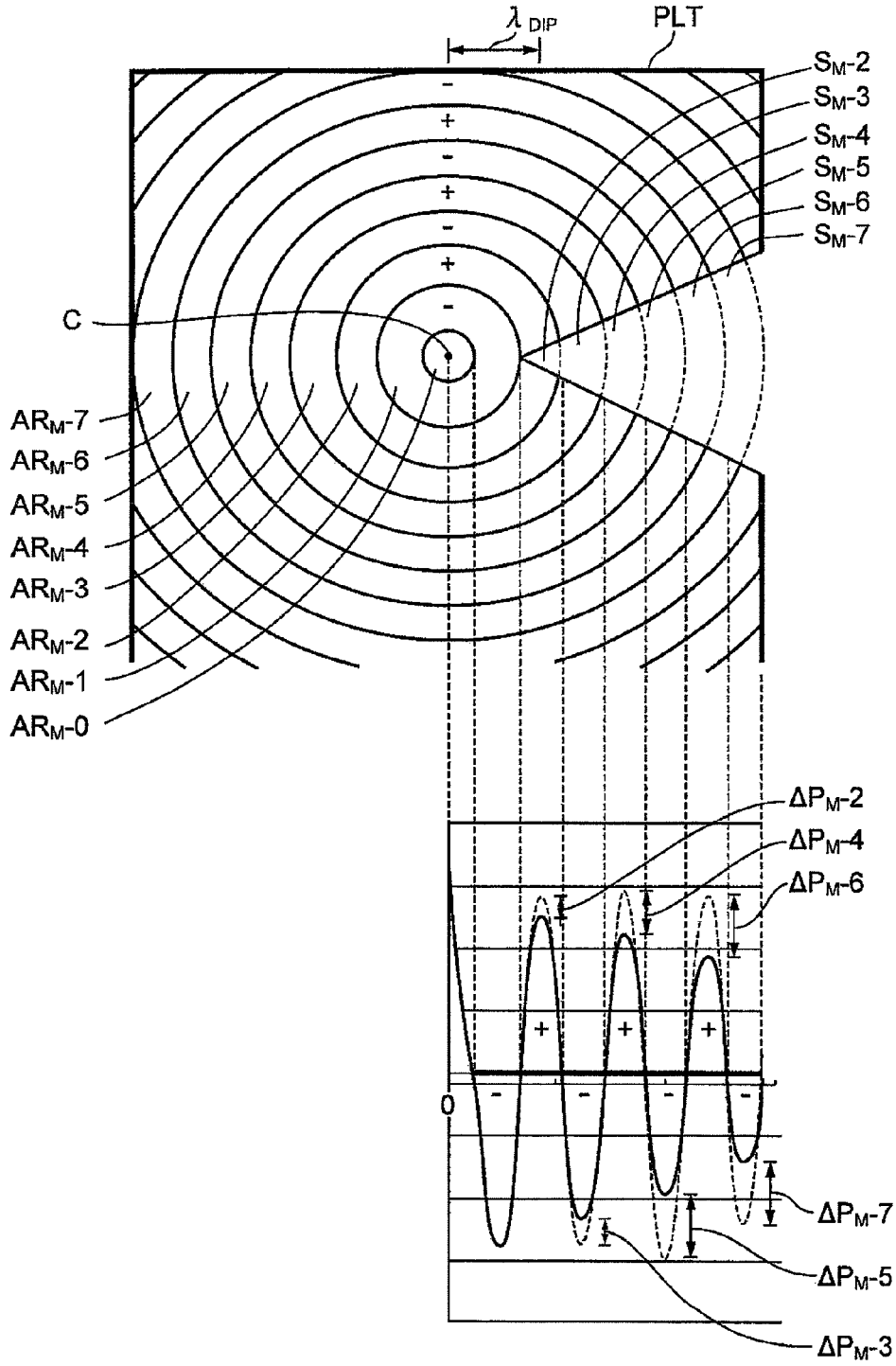
FIG. 18 is a view for explaining advantageous effects of the present invention.

The examinations conducted by the inventors have been described above. Here, in the present invention, one or a plurality of cutouts is/are formed in the baffle plate of the speaker so as to have a configuration in which a width of the one or the plurality of cutouts increases, in an entirety thereof, with an increase in a distance from the sound source. As in FIG. 16, on the baffle plate PLT having the cutout shown in FIG. 18, there are provided annular regions $AR_M$-1~$AR_M$-7 each of which has a center that coincides with the sound source C on the baffle plate PLT. Each annular region $AR_M$-1~$AR_M$-7 is defined by corresponding two of concentric circles each of which is distant from the sound source C by a distance of $\lambda_{DIP}/4+\lambda_{DIP}/2\times(m-1)$, wherein m=1~8. As shown in FIG. 18, the cutout is formed through six annular regions $AR_M$-2~$AR_M$-7. Where the sounds at the dip frequency are emitted, the total sum $SUM_{CIR}$ of the sound pressures of the reflected sounds emitted from the region $AR_M$-2, which is the most inward region among the six annular regions $AR_M$-2~$AR_M$-7 described above, is lowered by a sound pressure $\Delta P_M$-2 corresponding to an area $S_M$-2 of the cutout in the region $AR_M$-2. In the region $AR_M$-3 located immediately outward of the region $AR_M$-2, the total sum $SUM_{CIR}$ of the sound pressures of the reflected sounds emitted from the region $AR_M$-3 is increased by a sound pressure $\Delta P_M$-3 corresponding to an area $S_M$-3 of the cutout in the region $AR_M$-3. In the region $AR_M$-4 located immediately outward of the region $AR_M$-3, the total sum $SUM_{CIR}$ of the sound pressures of the reflected sounds emitted from the region $AR_M$-4 is lowered by a sound pressure $\Delta P_M$-4 corresponding to an area $S_M$-4 of the cutout in the region $AR_M$-4. In the region $AR_M$-5 located immediately outward of the region $AR_M$-4, the total sum $SUM_{CIR}$ of the sound pressures of the reflected sounds emitted from the region $AR_M$-5 is increased by a sound pressure $\Delta P_M$-5 corresponding to an area $S_M$-5 of the cutout in the region $AR_M$-5. In the region $AR_M$-6 located immediately outward of the region $AR_M$-5, the total sum $SUM_{CIR}$ of the sound pressures of the reflected sounds emitted from the region $AR_M$-6 is lowered by a sound pressure $\Delta P_M$-6 corresponding to an area $S_M$-6 of the cutout in the region $AR_M$-6. In the region $AR_M$-7 located immediately outward of the region $AR_M$-6, the total sum $SUM_{CIR}$ of the sound pressures of the reflected sounds emitted from the region $AR_M$-7 is increased by a sound pressure $\Delta P_M$-7 corresponding to an area $S_M$-7 of the cutout in the region $AR_M$-7.

Here, the relationship among the change amounts $\Delta P_M$-2, $\Delta P_M$-3, $P_M$-4, $\Delta P_M$-5, $\Delta P_M$-6, $\Delta P_M$-7 of the sound pressure of the reflected sounds in the respective regions $AR_M$-2, $AR_M$-3, $AR_M$-4, $AR_M$-5, $AR_M$-6, $AR_M$-7 is represented as follows: $\Delta P_M$-2<$\Delta P_M$-3<$\Delta P_M$-4<$\Delta P_M$-5<$\Delta P_M$-6<$\Delta P_M$-7. In this instance, therefore, a total sum $SUM_{RAD}$ of the sound pressures of the reflected sounds emitted from the regions $AR_M$-1-$AR_M$-7 changes in the positive direction as a whole. As a result, the sound pressure which acts on the listening point Z1 also changes in the positive direction, whereby the steepness of the dip at the corresponding frequency is mitigated.

Figure 19:
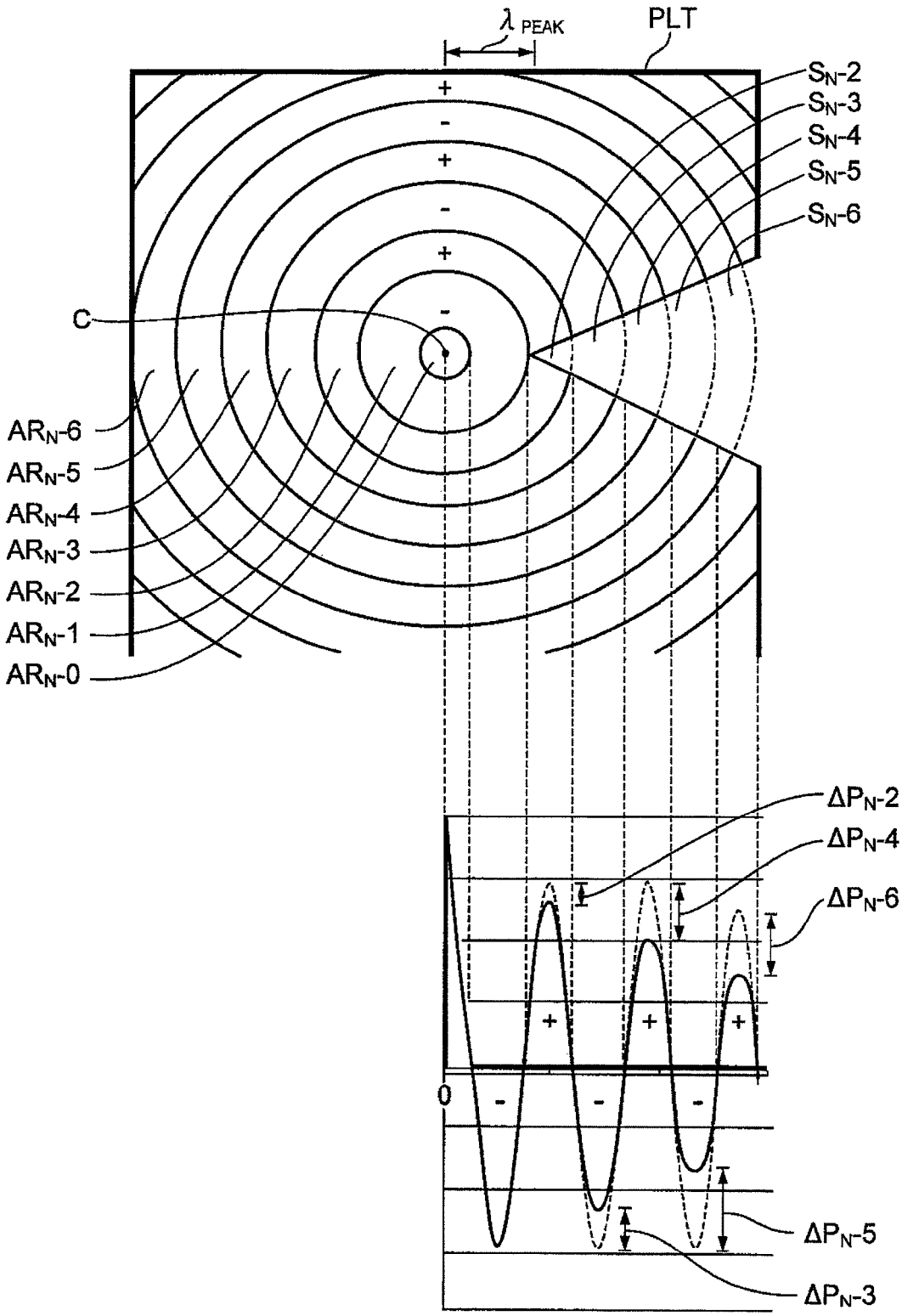
FIG. 19 is a view for explaining advantageous effects of the present invention.

Further, as in FIG. 17, on the baffle plate PLT having the cutout shown in FIG. 19, there are provided annular regions $AR_N$-1~$AR_N$-6 each of which has a center that coincides with the sound source C on the baffle plate PLT. Each of the regions $AR_N$-1~$AR_N$-6 is defined by corresponding two of concentric circles each of which is distant from the sound source C by a distance of $\lambda_{PEAK}/4+\lambda_{PEAK}/2\times(n-1)$, wherein n=1~7. As shown in FIG. 19, the cutout is formed through five annular regions $AR_N$-2~$AR_N$-6. Where the sounds at the peak frequency are emitted, the total sum $SUM_{CIR}$ of the sound pressures of the reflected sounds emitted from the region $AR_N$-2, which is the most inward region among the five annular regions $AR_N$-2~$AR_N$-6 described above, is lowered by a sound pressure $\Delta P_N$-2 corresponding to an area $S_N$-2 of the cutout in the region $AR_N$-2. In the region $AR_N$-3 located immediately outward of the region $AR_N$-2, the total sum $SUM_{CIR}$ of the sound pressures of the reflected sounds emitted from the region $AR_N$-3 is increased by a sound pressure $\Delta P_N$-3 corresponding to an area $S_N$-3 of the cutout in the region $AR_N$-3. In the region $AR_N$-4 located immediately outward of the region $AR_N$-3, the total sum $SUM_{CIR}$ of the sound pressures of the reflected sounds emitted from the region $AR_N$-4 is lowered by a sound pressure $\Delta P_N$-4 corresponding to an area $S_N$-4 of the cutout in the region $AR_N$-4. In the region $AR_N$-5 located immediately outward of the region $AR_N$-4, the total sum $SUM_{CIR}$ of the sound pressures of the reflected sounds emitted from the region $AR_N$-5 is increased by a sound pressure $\Delta P_N$-5 corresponding to an area $S_N$-5 of the cutout in the region $AR_N$-5. In the region $AR_N$-6 located immediately outward of the region $AR_N$-5, the total sum $SUM_{CIR}$ of the sound pressures of the reflected sounds emitted from the region $AR_N$-6 is lowered by a sound pressure $\Delta P_N$-6 corresponding to an area $S_N$-6 of the cutout in the region $AR_N$-6.

Here, the relationship among the change amounts $\Delta P_N$-2, $\Delta P_N$-3, $\Delta P_N$-4, $\Delta P_N$-5, $\Delta P_N$-6 of the sound pressure of the reflected sounds in the respective regions $AR_N$-2, $AR_N$-3, $AR_N$-4, $AR_N$-5, $AR_N$-6 is represented as follows: $\Delta P_N$-2<$\Delta P_N$-3<$\Delta P_N$-4<$\Delta P_N$-5<$\Delta P_N$-6. In this instance, therefore, a total sum $SUM_{RAD}$ of the sound pressures of the reflected sounds emitted from the regions $AR_N$-1~$AR_N$-6 changes in the negative direction as a whole. As a result, the sound pressure which acts on the listening point Z1 also changes in the negative direction, whereby the steepness of the peak at the corresponding frequency is mitigated.

Figure 20:
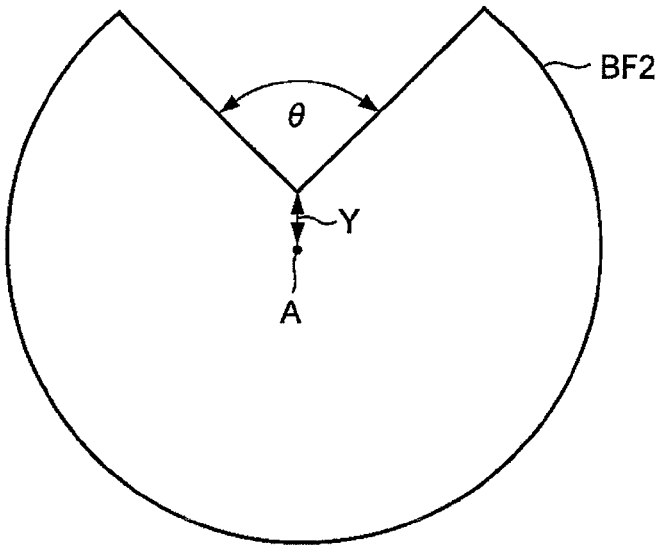
FIG. 20 is a view showing a baffle surface BF2 employed in verification of the advantageous effects of the present invention.
Figure 21:
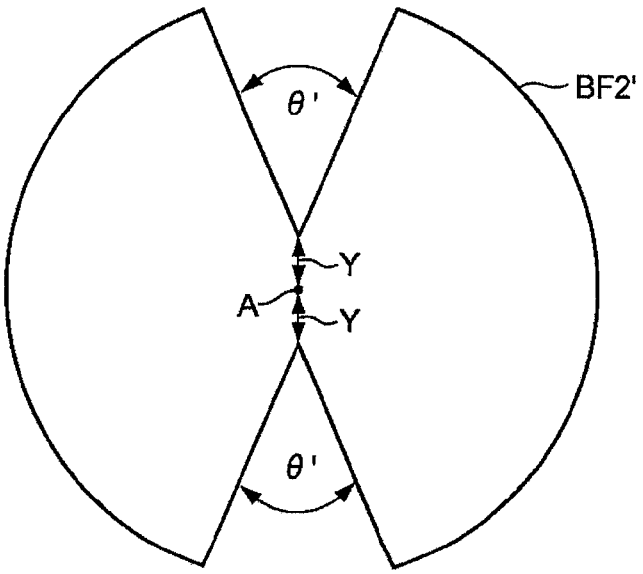
FIG. 21 is a view showing a baffle surface BF2' employed in verification of the advantages of the present invention.

The inventors conducted the following two verifications in order to confirm advantageous effects of the present invention. In the first verification, a frequency response was calculated in an instance in which one or a plurality of cutouts was/were formed in the baffle surface BF shown in FIG. 11 so as to have a width that increases with an increase in a distance from the center A. That is, in the first verification, a baffle surface BF2 shown in FIG. 20 was prepared, such that a portion of a perfect circle was cut out as follows. More specifically, a point which is on a radius of the perfect circle having a diameter D1 (D1=610 mm) and which is distant from a center A of the circle by a distance Y (Y=0.555 mm) is defined as a reference point. The above-indicted portion of the perfect circle is cut out, which portion is defined by: a line drawn from the reference point so as to be inclined toward left (in FIG. 20) by an angle θ/2 (θ=90 degrees) with respect to a straight line extending through the center A and the reference point; a line drawn from the reference point so as to be inclined toward right (in FIG. 20) by an angle θ/2 (θ=90 degrees) with respect to the straight line; and a part of the circumference of the circle, as shown in FIG. 20. That is, a sectorial portion whose center angle is 90 degrees is cut out. Further, a baffle surface BF2' shown in FIG. 21 was prepared such that two portions of a perfect circle were cut out as follows. More specifically, two points which are on a radius of a perfect circle having a diameter D1 (D1=610 mm) and which are distant from a center A of the circle in mutually opposite directions by a distance Y (Y=0.555 mm) are defined as reference points. The above-indicated two portions of the perfect circle which are opposite to each other in the diametrical direction are cut out. More specifically, each of the two portions is define by: a line drawn from the corresponding reference point so as to be inclined toward left (in FIG. 21) by an angle θ'/2 (θ'=45 degrees) with respect to a straight line extending through the center A and the reference point; a line drawn from the reference point so as to be inclined toward right (in FIG. 21) by an angle θ2' (θ'=45 degrees) with respect to the straight line; and a corresponding part of the circumference of the circle, as shown in FIG. 21. For the thus prepared baffle surfaces BF2 and BF2', there were calculated frequency responses as follows. A frequency response $R_{BF2}$ at the listening point Z1 was calculated where the center A of the baffle surface BF2 was a sound emitting point while a frequency response $R_{BF2}$ at the listening point Z1 was calculated where the center A of the baffle surface BF2' was a sound emitting point.

Figure 22A:
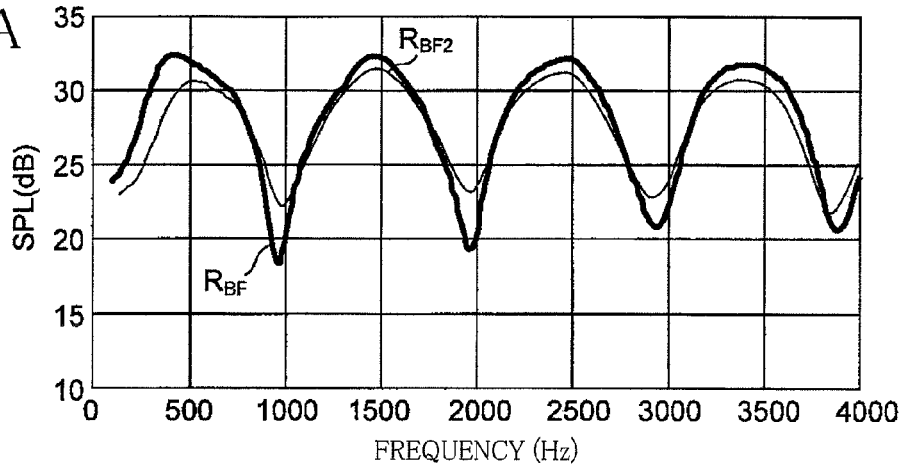
FIG. 22A is a graph showing a frequency response of the baffle surface BF2 and FIG. 22B is a graph showing a frequency response of the baffle surface BF2'.
Figure 22B:
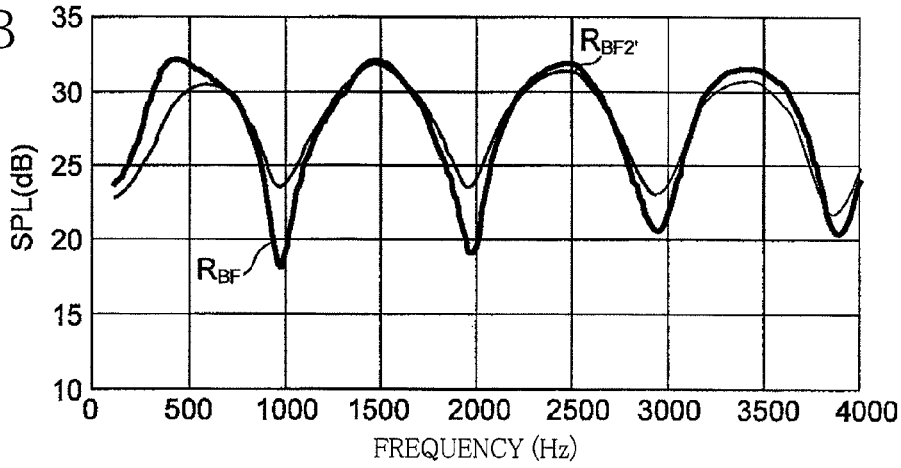

FIG. 22A is a graph in which the frequency response $R_{BF2}$ and the frequency response $R_{BF}$ shown in FIG. 12 are indicated such that frequency axes thereof are aligned with each other. FIG. 22B is a graph in which the frequency response $R_{BF2}$' and the frequency response $R_{BF}$ shown in FIG. 12 such that frequency axes thereof are aligned with each other. In each of the frequency responses $R_{BF2}$ and $R_{BF2}$' shown in FIGS. 22A and 22B, peaks appear at frequencies of about 430 Hz, 1400 Hz, 2400 Hz, and 3390 Hz while dips appear at frequencies of about 960 Hz, 1900 Hz, 2900 Hz, and 3890 Hz. However, the respective sound pressures at 430 Hz, 1400 Hz, 2400 Hz, and 3390 Hz in each of the frequency response $R_{BF2}$ and $R_{BF2}$' are lower than the respective sound pressures at 430 Hz, 1400 Hz, 2400 Hz, and 3390 Hz in the frequency response $R_{BF}$. Further, the respective sound pressures at 960 Hz, 1900 Hz, 2900 Hz, and 3890 Hz in each of the frequency responses $R_{BF2}$ and $R_{BF2}$' are higher than the respective sound pressures at 960 Hz, 1900 Hz, 2900 Hz, and 3890 Hz in the frequency response $R_{BF}$. Form the observations above, it was confirmed that the frequency response became close to flat one by forming, in the baffle plate of the speaker, one or a plurality of cutouts each having a width that increases with an increase in the distance from the center of the baffle plate of the speaker.

In the second verification, the sound pressure at the peak and the sound pressure at the dip in the frequency response was calculated in an instance where the dimensions Y and θ that determine the shape of the cutout of the baffle surface BF2 shown in FIG. 20 were varied. More specifically, the second verification utilized: a baffle surface BF1, BF3, BF4, BF5, and BF6 in which the distance Y in the baffle surface BF2 was made equal to 0.005 mm (Y=0.005), 0.105 mm (Y=0.105), 0.155 mm (Y=0.155), 0.205 mm (Y=0.205), and 0.255 mm (Y=0.255), respectively.

Figure 23:
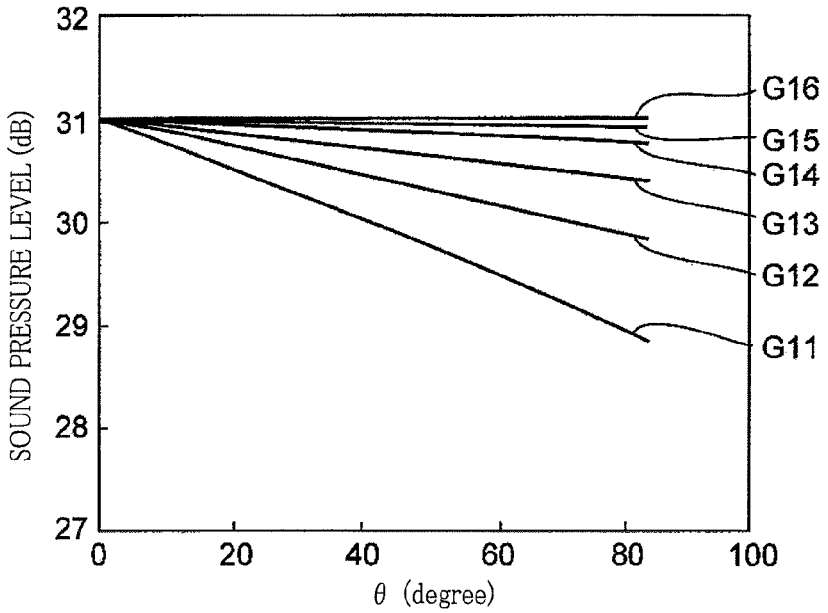
FIG. 23 is a graph showing a relationship between sound pressure at a peak in the frequency response of the baffle surface BF2 and angle θ of the baffle surface BF2.

In the second verification, for each of the six baffle surfaces including the above-described five baffle surfaces BF1, BF3, BF4, BF5, BF6 and the above-described baffle surface BF2, the sound pressure at the first-order peak of the frequency response was calculated in an instance where the angle θ in each baffle surfaces was varied within a range of 0≤θ≤90. In FIG. 23, the graph G11 indicates a change of the sound pressure at the first-order peak when the angle θ in the baffle surface BF1 was changed from 0 to 90 degrees. The graph G12 indicates a change of the sound pressure at the first-order peak when the angle θ in the baffle surface BF2 was changed from 0 to 90 degrees. The graph G13 indicates a change of the sound pressure at the first-order peak when the angle θ was changed from 0 to 90 degrees in the baffle surface BF3. The graph G14 indicates a change of the sound pressure at the first-order peak when the angle θ was changed from 0 to 90 degrees in the baffle surface BF4. The graph G15 indicates a change of the sound pressure at the first-order peak when the angle θ was changed from 0 to 90 degrees in the baffle surface BF5. The graph G16 indicates a change of the sound pressure at the first-order peak when the angle θ was changed from 0 to 90 degrees in the baffle surface BF6.

In each of the graphs G11, G12, G13, G14, G15, G16 in FIG. 23, the larger the angle θ, the lower the sound pressure at the first-order peak. It is accordingly confirmed that the sound pressure at the peak in the frequency response becomes closer to flat one as the angle θ becomes larger, where the distance Y is constant. Further, in each of the graphs G11, G12, G13, G14, G15, G16 in FIG. 23, the smaller the distance Y, the steeper the gradient. It is accordingly confirmed that the sound pressure at the peak in the frequency response becomes closer to flat one as the distance Y becomes smaller, where the angle θ is constant.

Figure 24:
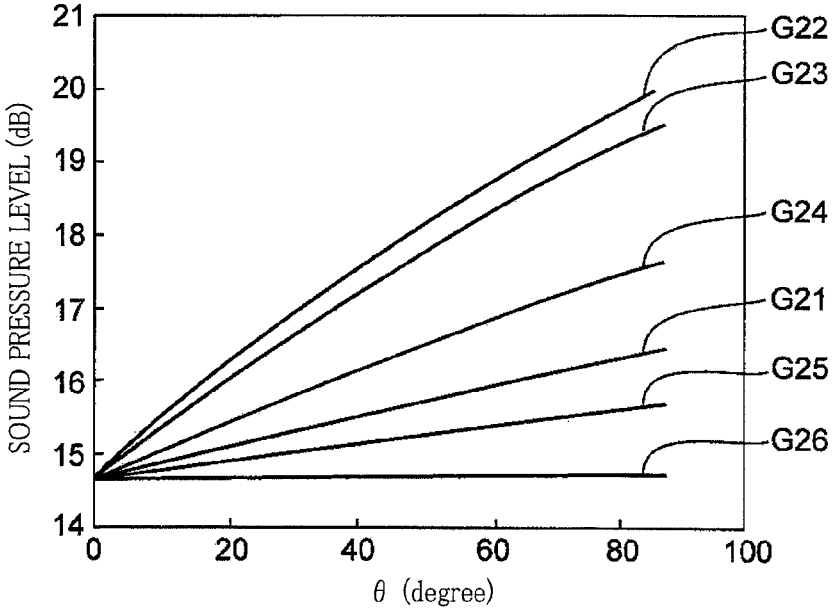
FIG. 24 is a graph showing a relationship between sound pressure at a dip in the frequency response of the baffle surface BF2 and angle θ of the baffle surface BF2.

In the second verification, for each of the six baffle surfaces BF1, BF2, BF3, BF4, BF5, BF6, the sound pressure at the first-order dip was calculated in an instance where the angle θ in each baffle surface was varied within a range of 0≤θ≤90. In FIG. 24, the graph G21 indicates a change of the sound pressure at the first-order dip when the angle θ was changed from 0 to 90 degrees in the baffle surface BF1. The graph G22 indicates a change of the sound pressure at the first-order dip when the angle θ was changed from 0 to 90 degrees in the baffle surface BF2. The graph G23 indicates a change of the sound pressure at the first-order dip when the angle θ was changed from 0 to 90 degrees in the baffle surface BF3. The graph G24 indicates a change of the sound pressure at the first-order dip when the angle θ was changed from 0 to 90 degrees in the baffle surface BF4. The graph G25 indicates a change of the sound pressure at the first-order dip when the angle θ was changed from 0 to 90 degrees in the baffle surface BF5. The graph G26 indicates a change of the sound pressure at the first-order dip when the angle θ was changed from 0 to 90 degrees in the baffle surface BF6.

In each of the graphs G21, G22, G23, G24, G25, G26 in FIG. 24, the larger the angle θ, the higher the sound pressure at the first-order dip. It is accordingly confirmed that the sound pressure at the dip in the frequency response becomes closer to flat one as the angle θ becomes larger, where the distance Y is constant. Further, in each of the graphs G21, G22, G23, G24, G25, G26 in FIG. 24, the relationship among the gradients of the respective lines G21, G22, G23, G24, G25 is represented as G22>G23>G24>G21>G25>G26. It is accordingly confirmed that the distance Y=0.555 is optimum for the dip and that the sound pressure at the dip in the frequency response becomes away from flat one in any of the cases in which the distance Y is smaller or larger than 0.555.

The at least one cutout formed in the baffle plate shown in FIGS. 18-21 has a configuration in which the width of each of the at least one cutout increases with an increase in the distance from the center of the baffle plate. This means that the configuration of the cutout corresponds to a configuration wherein an arc of a portion of a circle, which is a portion of the circle that passes the cutout or which is a portion of the circle that corresponds to the cutout, has a length that increases with an increase in a radius of the circle whose center coincides with the sound source, the circle being located in a plane which is parallel to the front face of the baffle plate and which is in the baffle plate.

There will be hereinafter explained embodiments of the present invention with reference to the drawings.

First Embodiment

Figure 1:
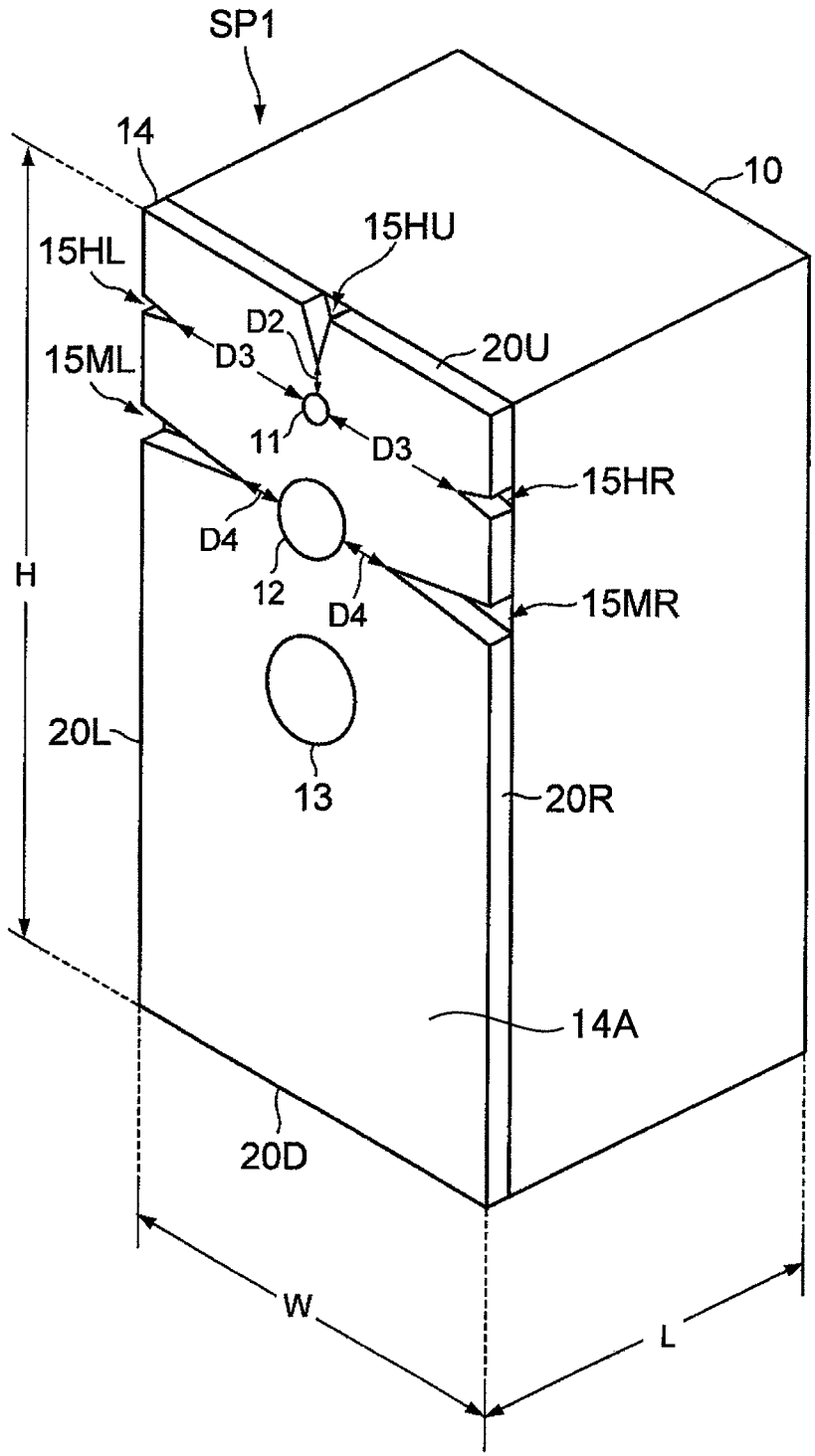
FIG. 1 is a perspective view of a speaker according to a first embodiment of the invention.

FIG. 1 is a perspective view of a speaker SP1 according to a first embodiment of the invention. The speaker SP1 includes an enclosure 10, a speaker unit 11, a speaker unit 12, and a speaker unit 13. The enclosure 10 is a member functioning as a casing for holding the speaker units 11, 12, 13. The enclosure 10 has a rectangular parallelepiped shape having a height dimension H (e.g., H=1000 mm), a width dimension W (e.g., W=520 mm), and a depth dimension L (e.g., L=480 mm). The speaker unit 11 functions as a first sound source for emitting, as sounds, components in a high-frequency range (3 kHz~10 kHz) in output signals of an audio device (not shown). The speaker unit 12 functions as a second sound source for emitting, as sounds, components in a middle-frequency range (500 Hz~3 kHz) in output signals of the audio device. The speaker unit 13 functions as a third sound source for emitting, as sounds, components in a low-frequency range (20 Hz~500 Hz) in output signals of the audio device.

The speaker unit 11 is fixed to an upper portion of a baffle plate 14 of the enclosure 10 at a widthwise central position of the baffle plate 14. The speaker unit 12 is fixed to a portion of the baffle plate 14 below the speaker unit 11 at a widthwise central position of the baffle plate 14. The speaker unit 13 is fixed to a portion of the baffle plate 14 below the speaker unit 12 at a widthwise central position of the baffle plate 14.

In the speaker SP1, cutouts 15HU, 15HL, 15HR are formed at a peripheral region of the baffle plate 14 of the enclosure 10, such that the cutouts 15HU, 15HL, 15HR are located on the upper side, the left side, and the right side of the speaker unit 11, respectively. Further, in the speaker SP1, cutouts 15ML, 15MR are formed at the peripheral region of the baffle plate 14 of the enclosure 10, such that the cutouts 15ML, 15MR are located on the left side and the right side of the speaker unit 12, respectively. The width of each of the cutouts 15HU, 15HL, 15HR increases with an increase in a distance from the speaker unit 11, namely, the width of each of the cutouts 15HU, 15HL, 15HR increases in a direction away from the speaker unit 11. The width of each of the cutouts 15ML, 15MR increases with an increase in the distance from the speaker unit 12, namely, the width of each of the cutouts 15ML, 15MR increases in a direction away from the speaker unit 12. More specifically, each of the cutouts 15HU, 15HL, 15HR has a triangular shape in which one of three apexes of the triangular shape is oriented toward the speaker unit 11. The cutout 15HU extends from a point on the baffle plate 14 which is distant upward from the speaker unit 11 by a distance D2, and reaches an upper end face 20U of the baffle plate 14. The width of the cutout 15HU is maximum at the upper end face 20U. The cutout 15HL extends from a point on the baffle plate 14 which is distant leftward from the speaker unit 11 by a distance D3, and reaches a left end face 20L of the baffle plate 14. The width of the cutout 15HL is maximum at the left end face 20L. The cutout 15HR extends from a point on the baffle plate 14 which is distant rightward from the speaker unit 11 by the distance D3, and reaches a right end face 20R of the baffle plate 14. The width of the cutout 15HR is maximum at the right end face 20R. Each of the cutouts 15ML, 15MR has a triangular shape in which one of three the apexes of the triangular shape is oriented toward the speaker unit 12. The cutout 15ML extends from a point on the baffle plate 14 which is distant leftward from the speaker unit 12 by a distance D4, and reaches the left end face 20L of the baffle plate 14. The width of the cutout 15ML is maximum at the left end face 20L. The cutout 15MR extends from a point on the baffle plate 14 which is distant rightward from the speaker unit 12 by the distance D4, and reaches the right end face 20R of the baffle plate 14. The width of the cutout 15MR is maximum at the right end face 20R. Here, correspondence between the speaker units and the cutouts will be explained. As shown in FIG. 1, the position of the cutout 15HU in the horizontal direction corresponds to or coincides with the position of the speaker unit 11 in the horizontal direction. The position of the cutout 15HL in the vertical direction corresponds to or coincides with the position of the speaker unit 11 in the vertical direction. The position of the cutout 15HR in the vertical direction corresponds to or coincides with the position of the speaker unit 11 in the vertical direction. Accordingly, each of the cutouts 15HU, 15HL, 15HR may be referred to as a cutout that corresponds to the speaker unit 11. Similarly, each of the cutouts 15ML, 15MR may be referred to as a cutout that corresponds to the speaker unit 12. Further, since the position of the cutout 15HU in the horizontal direction corresponds to or coincides with the position of each of the speaker units 11, 12, 13 in the horizontal direction, the cutout 15HU may be also referred to as a cutout that corresponds to the speaker units 11, 12, 13.

In the first embodiment, the width of the cutout is a size of the cutout in a direction perpendicular to a direction from the corresponding or associated speaker unit to the cutout, more specifically, in a direction from the center of the corresponding speaker unit to one of the apexes of the cutout that is the nearest to the speaker unit. (This direction is hereinafter referred to as a "reference width direction" where appropriate.) The reference width direction is a direction parallel to a front face 14A of the baffle plate 14 to which the speaker unit 13 is attached and which faces an exterior of the speaker SP1. In FIG. 1, where the front face 14A of the baffle plate 14 is a plane parallel to the vertical direction, the reference width direction of the cutout 15HU is a direction which is parallel to the horizontal direction and which is parallel to the front face 14A. The reference width direction of each of the cutputs 15HL, 15HR, 15ML, 15MR is the vertical direction. The size of each cutout in the thus defined reference width direction becomes larger with an increase in the distance from the corresponding speaker unit, in other words, the size of each cutout in the reference width direction becomes larger in a direction away from the corresponding speaker unit.

The details of the first embodiment have been described above. According to the first embodiment, it is possible to reduce a difference between: the sound pressure generated at the listening point when the sounds at the dip frequency are emitted and the sound pressure generated at the listening point when the sounds at the peak frequency are emitted, so that the frequency response at the listening point can be made closer to flat one.

Figure 2:
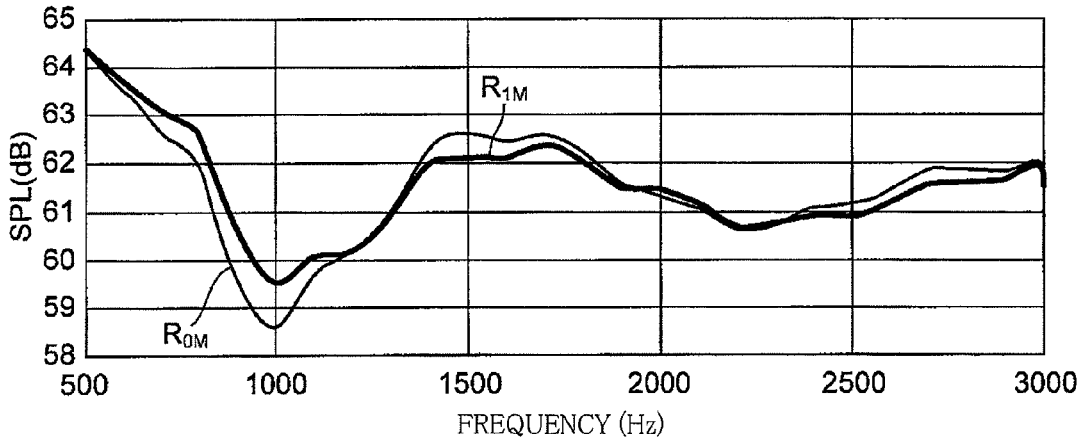
FIG. 2 is a graph showing frequency responses obtained for verification of advantageous effects of the speaker of FIG. 1.

Here, the inventors conducted the following two verifications in order to confirm advantageous effects of the first embodiment. In the first verification, there was prepared, as a speaker SP1', an acoustic device constituted by the baffle plate 14 and the speaker units 11, 12 of the speaker SP1, namely, an acoustic device in which the speaker unit 13 on the baffle plate 14 and portions of the enclosure 10 of the speaker SP1 except the baffle plate 14 were removed. A frequency response $R_{1M}$ at a listening point Z2 which was distant, by 1000 mm, from the speaker unit 12 in the frontward direction of the speaker SP1' was calculated in an instance where sounds in a middle-frequency range (500 Hz~3 kHz) were emitted from the speaker unit 12 of the speaker SP1'. Further, a speaker SP0 was prepared which was the same as the speaker SP1' except that the cutouts 15HU, 15HL, 15HR, 15ML, 15MR were not formed in the baffle plate 14. A frequency response $R_{0M}$ at the listening point Z2 was calculated in an instance where the sounds in the middle-frequency range (500 Hz-3 kHz) were emitted from the speaker unit 12 of the speaker SP0. In FIG. 2, the frequency responses $R_{1M}$, $R_{0M}$ are indicated such that the frequency axes thereof are aligned with each other. As shown in FIG. 2, first-order dip appears at 1000 Hz and first-order peak appears at 1400 Hz in the frequency responses $R_{1M}$ and $R_{0M}$. The sound pressure of the first-order dip in the frequency response $R_{1M}$ is higher than the sound pressure of the first-order dip in the frequency response $R_{0M}$. The sound pressure of the first-order peak in the frequency response $R_{1M}$ is lower than the sound pressure of the first-order peak in the frequency response $R_{0M}$. It is confirmed from the above observations that the frequency response in the middle-frequency range (500 Hz~3 kHz) can be made closer to flat one according to the first embodiment.

Figure 3:
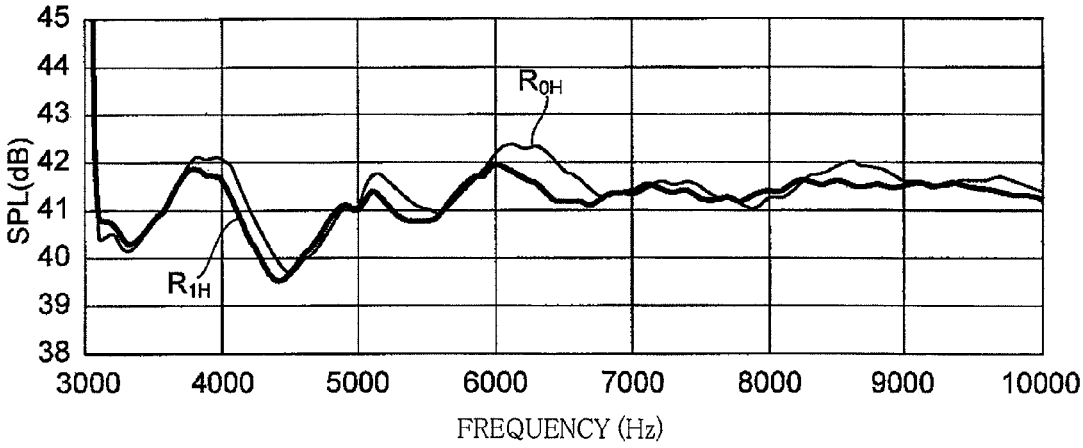
FIG. 3 is a graph showing frequency responses obtained for verification of advantageous effects of the speaker of FIG. 1.

In the second verification, a frequency response $R_{1-1}$ at the listening point Z2 was calculated in an instance where sounds in the high-frequency range (3 kHz~10 kHz) were emitted from the speaker unit 11 of the speaker SP1'. Further, a frequency response $R_{0H}$ at the listening point Z2 was calculated in an instance where the sounds in the high-frequency range (3 kHz~10 kHz) were emitted from the speaker unit 11 of the speaker SP0. In FIG. 3, the frequency responses $R_{1H}$, $R_{0H}$ are indicated such that the frequency axes thereof are aligned with each other. As shown in FIG. 3, the first-order dip appears at 3390 Hz and the first-order peak appears at 3900 Hz in the frequency responses $R_{1H}$, $R_{0H}$. The sound pressure of the first-order dip in the frequency response $R_{1H}$ is higher than the sound pressure of the first-order dip in the frequency response $R_{0H}$. The sound pressure of the first-order peak in the frequency response $R_{1H}$ is lower than the sound pressure of the first-order peak in the frequency response $R_{0H}$. It is confirmed from the above observations that the frequency response in the high-frequency range (3 kHz~10 kHz) can be made closer to flat one according to the first embodiment.

Second Embodiment

Figure 4:
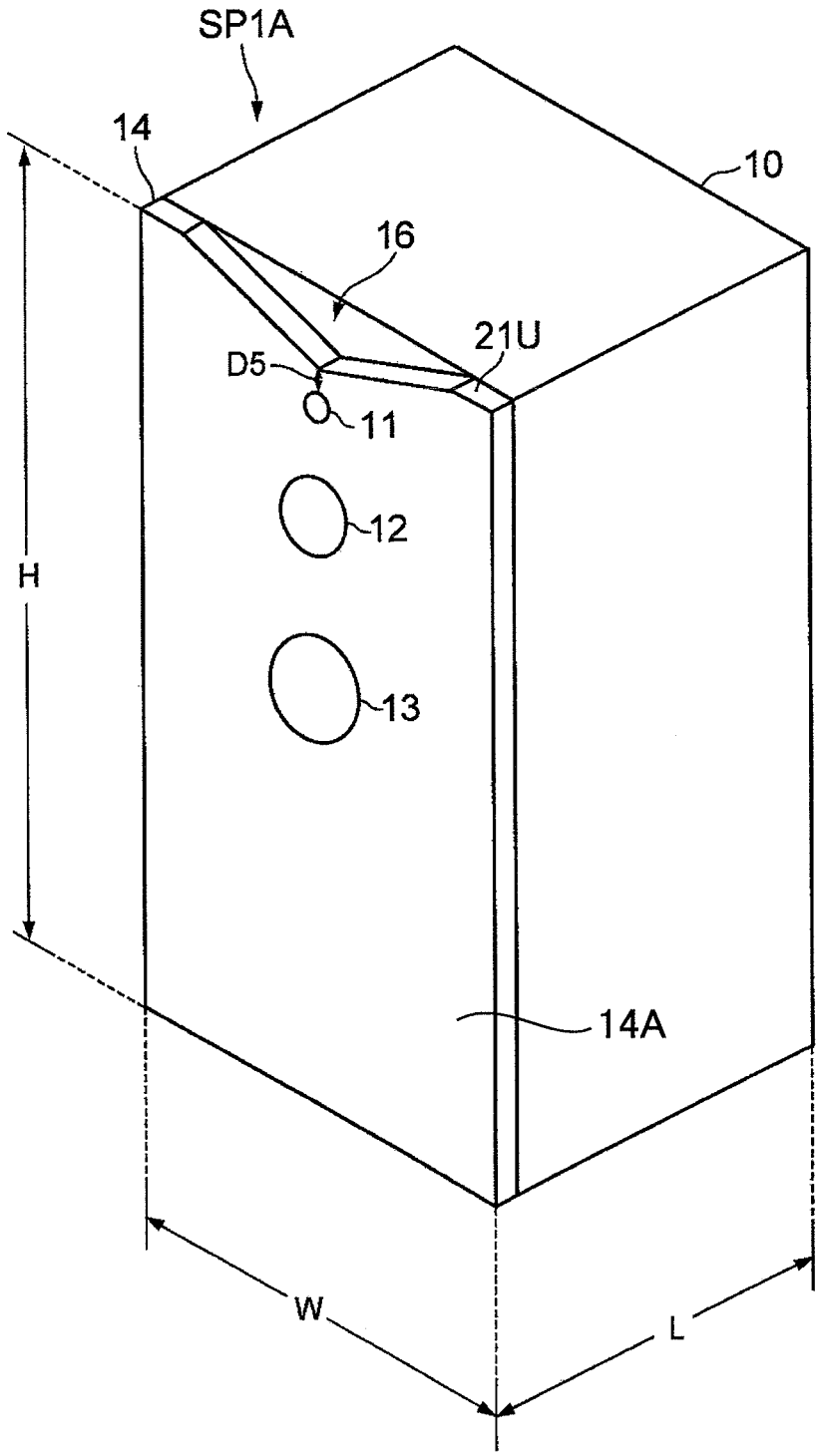
FIG. 4 is a perspective view of a speaker according to a second embodiment of the invention.

FIG. 4 is a perspective view of a speaker SP1A according to a second embodiment of the present invention. In the speaker SP1A, a cutout 16 is formed at a portion of the baffle plate 14 of the enclosure 10 above the speaker unit 11. The cutout 16 has a width that increases with an increase in a distance from the speaker unit 11. More specifically, the cutout 16 has a triangular shape in which one of three apexes of the triangular shape is oriented toward the speaker unit 11. The cutout 16 extends from a point which is distant upward from the speaker unit 11 on the baffle plate 14 by a distance D5, and reaches an upper end face 21U of the baffle plate 14. The width of the cutout 16 is maximum at the upper end face 21U. In FIG. 4, where the front face 14A of the baffle plate 14 is a plane parallel to the vertical direction, the reference width direction of the cutout 16 is a direction which is parallel to the horizontal direction and which is parallel to the front face 14A. The size of the cutout 16 in the thus defined reference width direction becomes larger with an increase in a distance from the corresponding speaker unit 11 (or 12, 13), in other words, the size of the cutout 16 in the reference width direction becomes larger in a direction away from the corresponding speaker unit 11 (or 12, 13).

The details of the second embodiment have been described above. According to the second embodiment, it is possible to reduce a difference between: the sound pressure generated at the listening point when the sounds at the dip frequency are emitted; and the sound pressure generated at the listening point when the sounds at the peak frequency are emitted, so that the frequency response at the listening point can be made closer to flat one.

Figure 5:
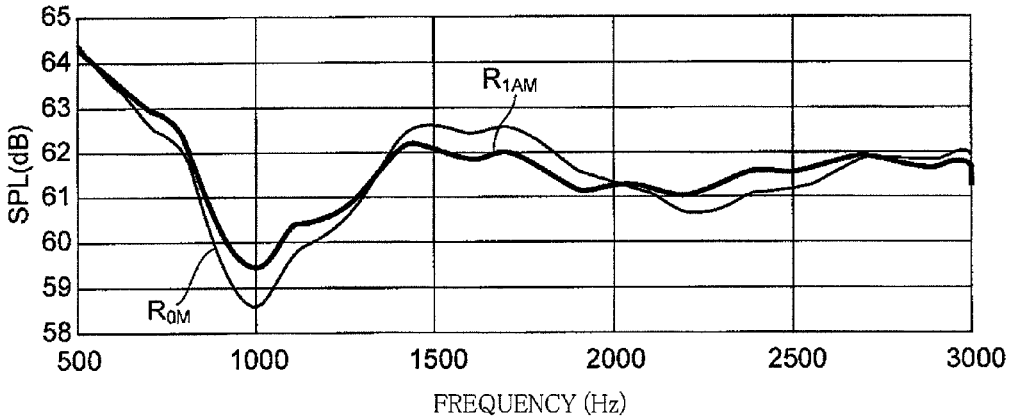
FIG. 5 is a graph showing frequency responses obtained for verification of advantageous effects of the speaker of FIG. 4.

Here, the inventors conducted the following two verifications in order to confirm advantageous effects of the second embodiment. In the first verification, there was prepared, as a speaker SP1A', an acoustic device constituted by the baffle plate 14 of the speaker SP1A and the speaker units 11, 12, namely, an acoustic device in which the speaker unit 13 on the baffle plate 14 and portions of the enclosure 10 of the speaker SP1A except the baffle plate 14 were removed. A frequency response $R_{1AM}$ at the listening point Z2 was calculated in an instance where the sounds in the middle-frequency range (500 Hz-3 kHz) were emitted from the speaker unit 12 of the speaker SP1A'. In FIG. 5, the frequency response $R_{1AM}$ and the frequency response $R_{0M}$ obtained in the verification in the illustrated first embodiment are indicated such that the frequency axes thereof are aligned with each other. As shown in FIG. 5, the sound pressure of the first-order dip in the frequency response $R_{1AM}$ is higher than the sound pressure of the first-order dip in the frequency response $R_{0M}$. The sound pressure of the first-order peak in the frequency response $R_{1AM}$ is lower than the sound pressure of the first-order peak in the frequency response $R_{0M}$. It is confirmed from the observations that the frequency response in the middle-frequency range (500 Hz~3 kHz) can be made closer to flat one according to the present embodiment.

Figure 6:
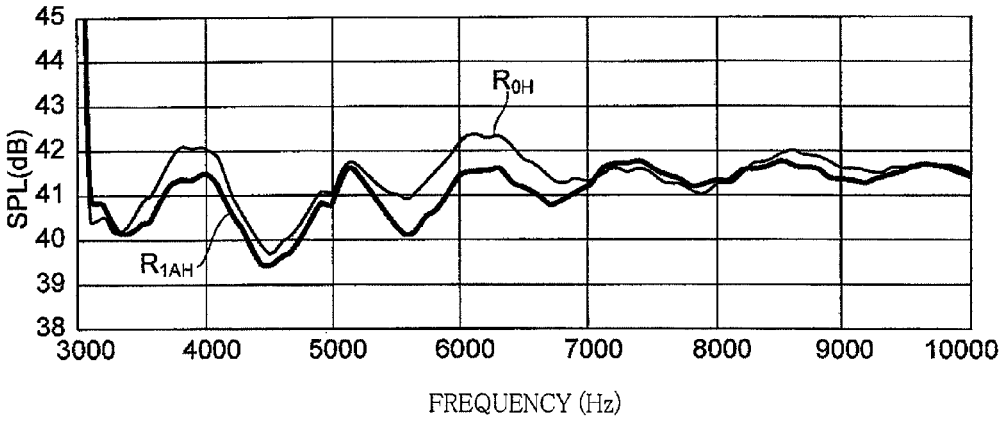
FIG. 6 is a graph showing frequency responses obtained for verification of advantageous effects of the speaker of FIG. 4.

In the second verification, a frequency response $R_{1AH}$ at the listening point Z2 was calculated in an instance where the sounds in the high-frequency range (3 kHz~10 kHz) were emitted from the speaker unit 11 of the speaker SP1A'. In FIG. 6, the frequency response $R_{1AH}$ and the frequency response $R_{0H}$ obtained in the verification in the illustrated first embodiment are indicated such that the frequency axes thereof are aligned with each other. As shown in FIG. 6, the sound pressure of the first-order dip in the frequency response $R_{1AH}$ is higher than the sound pressure of the first-order dip in the frequency response $R_{0H}$. The sound pressure of the first-order peak in the frequency response $R_{1AH}$ is lower than the sound pressure of the first-order peak in the frequency response $R_{0H}$. It is confirmed from the observations that the frequency response in the high-frequency range (3 kHz~10 kHz) can be made closer to flat one according to the second embodiment.

Third Embodiment

Figure 7A:
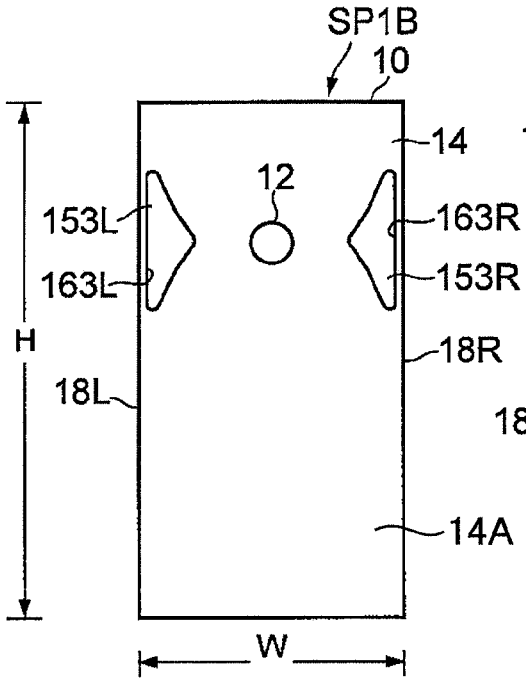
FIG. 7A is a front view and FIG. 7B is a side view of a speaker according to a third embodiment of the invention.
Figure 7B:
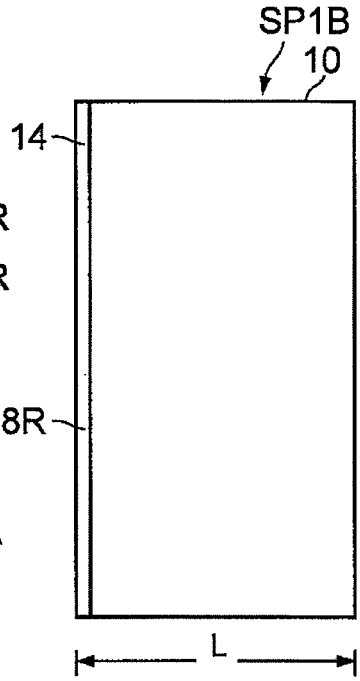

FIG. 7A is a front view of a speaker SP1B according to a third embodiment of the present invention. FIG. 7B is a right side view of the speaker SP1B. In the illustrated first and second embodiments, a part of the periphery of each of the cutouts 15HU, 15HL, 1511R, 15ML, 15MR, 16 formed in the baffle plate 14 reaches the end of the baffle plate 14, namely, reaches a corresponding one of the end faces of the baffle plate 14. In contrast, in this third embodiment, the periphery of the cutout formed in the baffle plate 14 is entirely surrounded by the baffle plate 14. More specifically, in the speaker SP1B, one speaker unit 12 is provided at an upper portion of the baffle plate 14 in a widthwise central position of the same 14. A cutout 153L is formed in the baffle plate 14 on the left side of the speaker unit 12 while a cutout 153R is formed in the baffle plate 14 on the right side of the speaker unit 12. Each of the cutouts 153L, 153R has a triangular shape in which one of three apexes of the triangular shape is oriented toward the speaker unit 12. In each of the cutouts 153L, 153R, the angle formed by two sides which define the apex that is oriented toward the speaker unit 12 is an obtuse angle. In the speaker SP1B, an end face 163L of the cutout 153L which is opposite to the apex oriented toward the speaker unit 12 is parallel to a left end face 18L of the baffle plate 14, and the end face 163L of the cutout 153L is slightly away from the left end face 18L in the inward direction or toward the speaker unit 12. An end face 163R of the cutout 153R which is opposite to the apex oriented toward the speaker unit 12 is parallel to a right end face 18R of the baffle plate 14, and the end face 163R of the cutout 153R is slightly away from the right end face 18R in the inward direction or toward the speaker unit 12. The details of the third embodiment have been explained above. Each cutout 153L, 153R in the form of a slit in the present embodiment has a shape in which the width of the cutout increases with an increase in a distance from the speaker unit 12, namely, the width of the cutout increases in a direction away from the speaker unit 12. In this embodiment, the frequency response at the listening point can be made closer to flat one. While, in the third embodiment, the width of each cutout may be considered as a size of the cutout in the reference width direction explained above, the width of the cutout may be considered as follows. That is, the width of the cutout in the third embodiment refers to a size of the cutout in a direction (i.e., the reference width direction) that is perpendicular to a direction from the corresponding speaker unit to the cutout, more specifically, perpendicular to a direction from the center of the corresponding speaker unit to a portion of the cutout which is nearest to the speaker unit. In FIG. 7A, where the front face 14A of the baffle plate 14 is a plane parallel to the vertical direction, the reference width direction of each cutout 153L, 153R coincides with the vertical direction. The size of the cutout in the thus defined reference width direction becomes larger with an increase in the distance from the corresponding speaker unit, in other words, the size of each cutout in the reference width direction becomes larger in a direction away from the corresponding speaker unit.

Fourth Embodiment

Figure 8A:
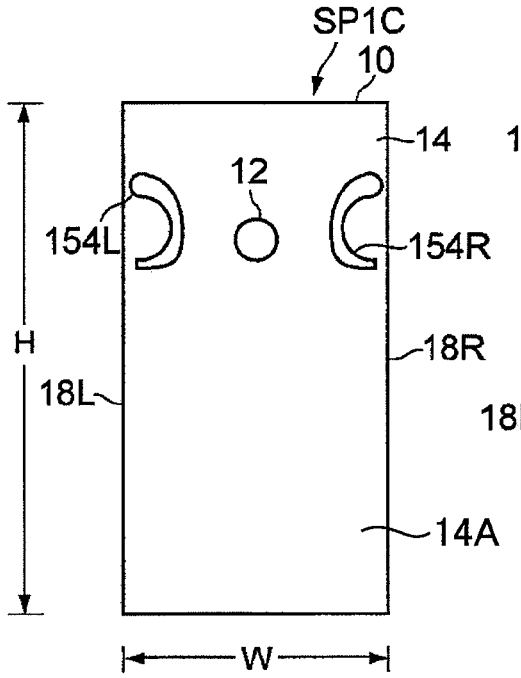
FIG. 8A is a front view and FIG. 8B is a side view of a speaker according to a fourth embodiment of the invention.
Figure 8B:
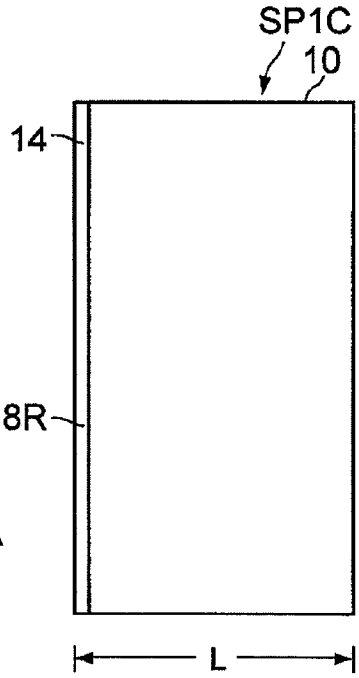

FIG. 8A is a front view of a speaker SP according to a fourth embodiment of the present invention. FIG. 8B is a right side view of the speaker SP1C. In the speaker SP1C, the cutout 153L and the cutout 153R in the speaker SP1B (FIGS. 7A and 7B) are respectively replaced with a cutout 154L and a cutout 154R each of which is in the form of a through-hole and each of which is curved so as to be convex toward the speaker unit 12 as the sound source, for design improvement. More specifically, each of the cutouts 154L, 154R formed in the baffle plate 14 of the speaker SP1C has a crescent-like shape. The curved convex portion of the cutout 154L is oriented toward the speaker unit 12, and its upper and lower end portions are oriented toward the left end face 18L of the baffle plate 14. The curved convex portion of the cutout 154R is oriented toward the speaker unit 12, and its upper and lower end portions are oriented toward the right end face 18R of the baffle plate 14. The details of the fourth embodiment have been explained above. In this embodiment, too, the cutout has a width that increases with an increase in a distance from the corresponding speaker unit, in other words, a width that increases in a direction away from the corresponding speaker unit, whereby the frequency response at the listening point can be made closer to flat one according to the present embodiment.

Fifth Embodiment

Figure 9A:
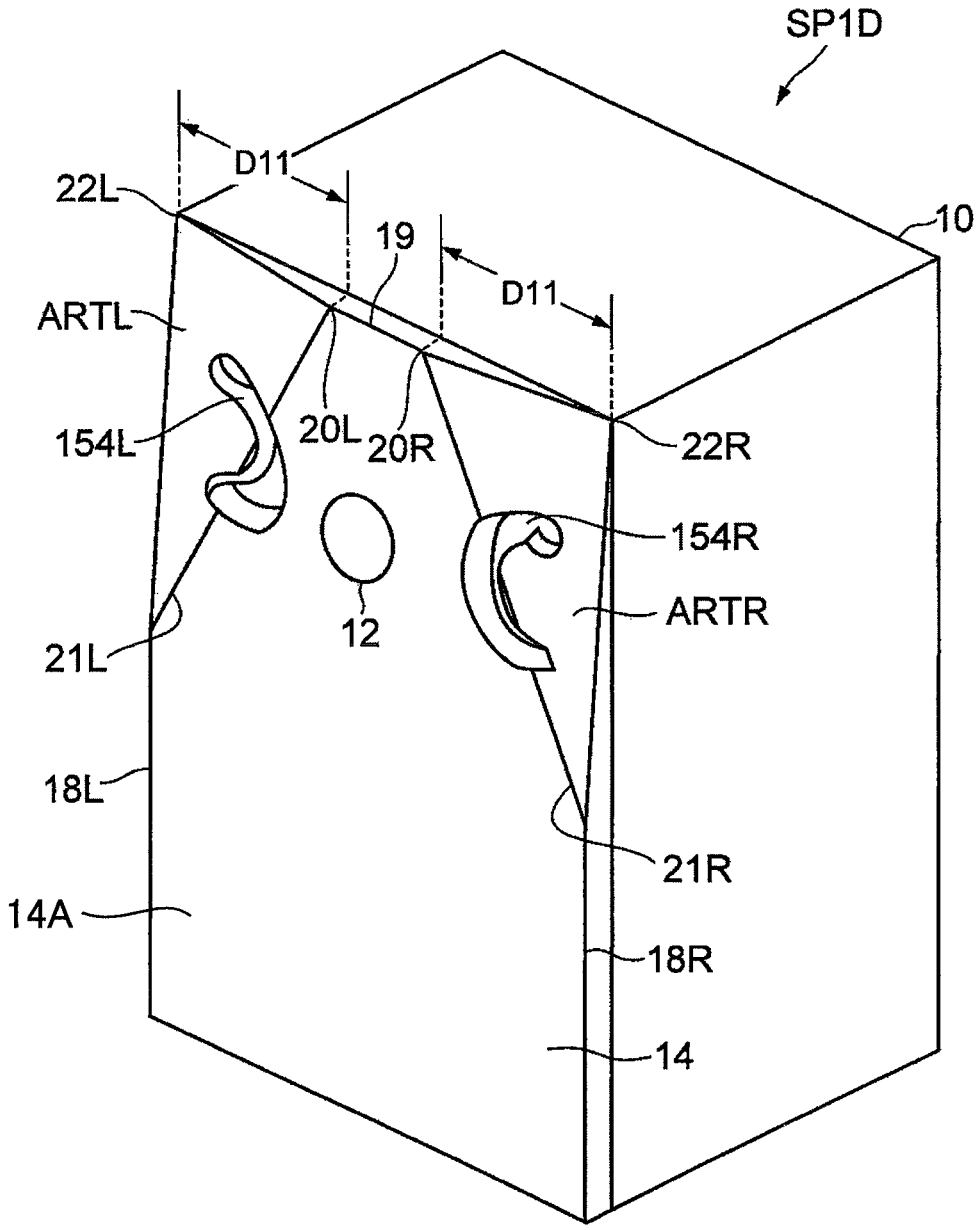
FIG. 9A is perspective view of a speaker according to a fifth embodiment of the invention and FIG. 9B is a perspective view of a speaker according to a sixth embodiment of the invention.

FIG. 9A is a perspective view of a speaker SP1D according to a fifth embodiment of the present invention. In the speaker SP1D, inclinations are respectively formed at regions of the baffle plate 14 in the speaker SP1C (FIGS. 8A and 8B) which respectively include the cutout 154L and the cutout 154R each in the form of a through-hole. More specifically, in the speaker SP1D, a region ARTL having a triangular shape is defined by: a part of the left end face 18L; a part of the upper end face 19; and a line 21L which extends from a point 20L that is distant rightward from the left end of the upper end face 19 of the baffle plate 14 by a distance D11 and reaches the left end face 18L of the baffle plate 14 through the cutout 154L. The region ARTL has a thickness which gradually decreases in a direction from the line 21L toward an apex 22L at the upper-left corner of the baffle plate 14. Further, a region ARTL having a triangular shape is defined by: a part of the right end face 18R; a part of the upper end face 19; and a line 21R which extends from a point 20R that is distant leftward from the right end of the upper end face 19 of the baffle plate 14 by a distance D11 and reaches the right end face 18R through the cutout 154R. The region ARTR has a thickness which gradually decreases in a direction from the line 21R toward an apex 22R at the upper-right corner of the baffle plate 14. The details of the fifth embodiment have been described above. In the fifth embodiment, most of reflected waves which have reflected on the inclined regions ARTL, ARTR on the baffle plate 14 are again emitted outside the straightforward direction of the baffle plate 14 in which the listening point exists. According to the present embodiment, it is possible to reduce a difference between: the sound pressure of the sounds at the peak frequency at the listening point and the sound pressure of the sounds at the dip frequency at the listening point.

Sixth Embodiment

Figure 9B:
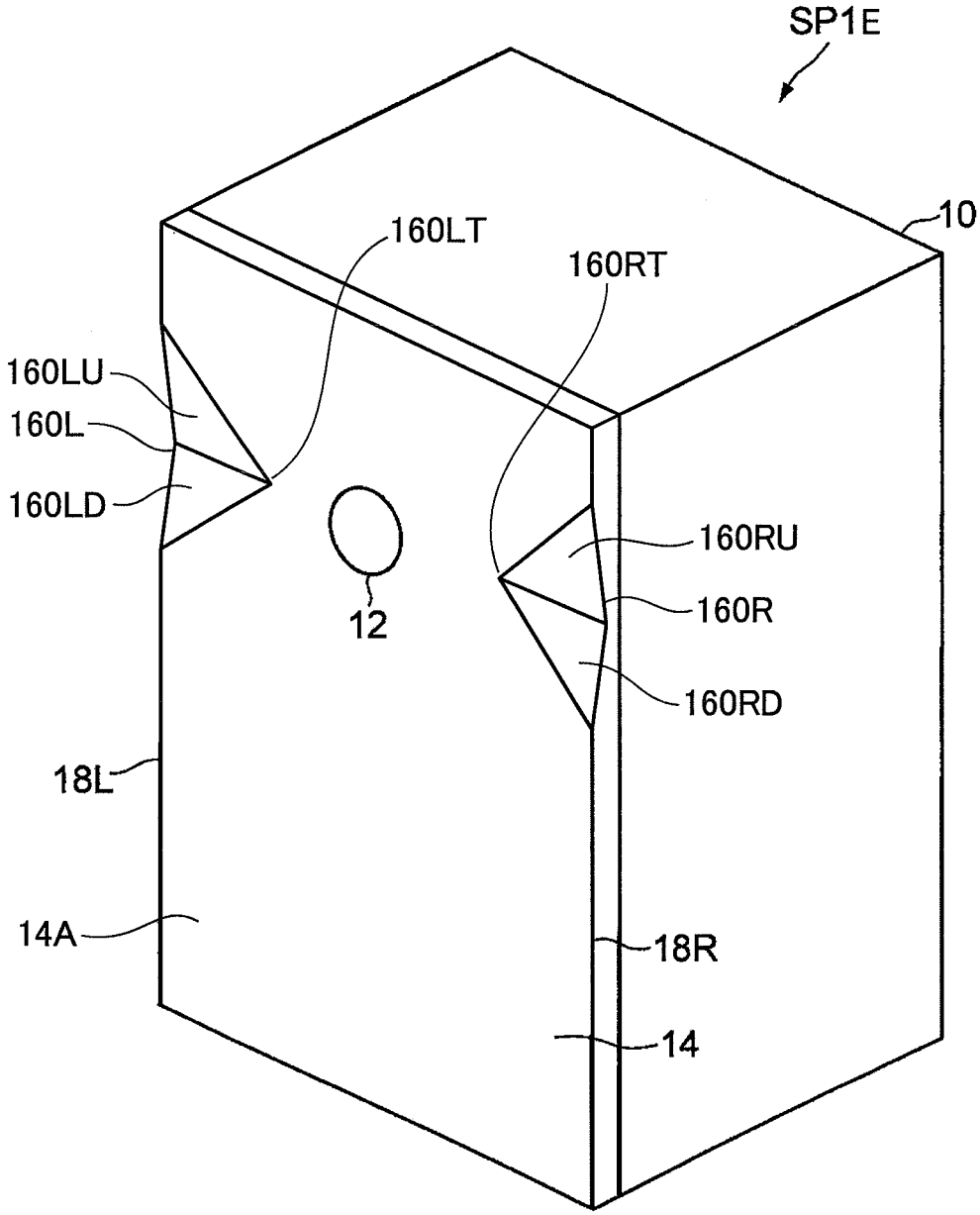

FIG. 9B is a perspective view of a speaker SP1E according to a sixth embodiment of the present invention. In the speaker SP1E, an inclined portion 160L and an inclined portion 160R are formed on the baffle plate 14. More specifically, in the speaker SP1E, each of the inclined portions 160L, 160R is formed at a position on the baffle plate 14 which corresponds to the speaker unit 12 in the vertical direction, such that each inclined portion 160L, 160R has a concave shape which is inwardly recessed into the inside of the enclosure 10 relative to the front face 14A of the baffle plate 14. This means that the inclined portions 160L, 160R correspond to the speaker unit 12. Since the inclined portion 160L and the inclined portion 160R are formed so as to be point-symmetrical relative to the speaker unit 12, the inclined portion 160L will be particularly explained. The inclined portion 160L includes an inclined surface 160LU and an inclined surface 160LD which have reflection characteristics different from those of the front face 14A of the baffle plate 14 except the inclined portions 160L, 160R. The inclined surface 160LU is oriented in a vertically downward direction with respect to the horizontal direction while the inclined surface 160LD is oriented in a vertically upward direction with respect to the horizontal direction. In this respect, the front face 14A of the baffle plate 14 is oriented in the horizontal direction. Both of the inclined surfaces 160LU, 160LD are formed so as to reach the left end face 18L of the baffle plate 14. In this arrangement, therefore, where the inclined portion 160L and the inclined portion 160R are viewed from the front side of the speaker SP1E, one 160LT of apexes of the inclined portion 160L and one 160RT of apexes of the inclined portion 160R are located at the same position in the vertical direction as the center of the speaker unit 12, and the other two apexes of the inclined portion 160L are located on the left end face 18L while the other two apexes of the inclined portion 160R are located on the right end face 18R.

Each of the inclined portions 160L, 160R has a width that increases with an increase in a distance from the speaker unit 12. In the sixth embodiment, the width of the inclined portion refers to a size of the inclined portion in a direction (i.e., the reference width direction) that is perpendicular to a direction from the corresponding speaker unit to the inclined portion, more specifically, perpendicular to a direction from the center of the corresponding speaker unit to the one of the apexes of the inclined portion which is the nearest to the speaker unit. In FIG. 9B, where the front face 14A of the baffle plate 14 is a plane parallel to the vertical direction, the reference width direction of each of the inclined portions 160L, 160R coincides with the vertical direction.

In the present embodiment, most of reflected waves which have reflected on the inclined surfaces 160RU, 160RD, 160LU, 160LD of the inclined portions 160R, 160L as inclined regions on the baffle plate 14 are again emitted outside the straightforward direction of the baffle plate 14. According to the present embodiment, it is possible to reduce a difference between: the sound pressure of the sounds at the peak frequency at the listening point and the sound pressure of the sounds at the dip frequency at the listening point.

Other Embodiments

While the embodiments of the present invention have been explained above, it is to be understood that the invention may be otherwise embodied with various other changes and modifications which may occur to those skilled in the art, without departing from the scope of the invention defined in the attached. Hereinafter, other embodiments will be explained.

(1) In the illustrated first and second embodiments, the three speaker units 11, 12, 13 are provided on the baffle plate 14. The number of the speaker units on the baffle plate 14 may be one, two, or four or more. Further, the cutouts may be formed such that each cutout includes, as a part of its outer periphery, an arc of a circle whose center coincides with the center of the corresponding speaker unit.

(2) In the illustrated first and second embodiments, each of the cutouts 15HU, 15HL, 15HR has the triangular shape in which the one of the apexes is oriented toward the speaker unit 11 while each of the cutouts 15ML, 15MR has the triangular shape in which the one of the apexes is oriented toward the speaker unit 12. As long as each cutout has the configuration in which the width thereof increases with an increase in the distance from the speaker unit 11 or 12, in other words, the width increases in a direction away from the speaker unit 11 or 12, the cutout may not necessarily have the triangular shape and the position of the cutout is not limited to those in the illustrated embodiments. Further, the number of the cutouts is not particularly limited.

(3) In the illustrated first and second embodiments, the cutouts 15HU, 15HL, 15HR are formed through the thickness of the baffle plate 14 so as to be open to both of the front and back faces thereof. Each of the cutouts 15HU, 15HL, 15HR may be formed so as to have a concave shape that is recessed from the front face of the baffle plate 14 by a suitable amount.

(4) In the illustrated fifth embodiment, the speaker SP1D is formed such that the inclinations are respectively formed at the regions of the baffle plate 14 in the speaker SP1C of the fourth embodiment, which regions respectively include the cutout 154L and the cutout 154R. There may be formed inclinations at regions of the baffle plate 14 which include the cutouts 15HU, 15HL, 15HR, 15ML, 15MR in the speaker SP1 of the illustrated first embodiment. Further, there may be formed inclinations at regions of the baffle plate 14 which include the cutout 16 in the speaker SP1A of the illustrated second embodiment.

(5) In the illustrated first through fifth embodiments, at least one cutout is formed in the baffle plate 14 such that the width of the cutout increases with an increase in the distance from the corresponding speaker unit. In place of the cutout, there may be formed a convex portion, a concave portion, or a portion to which a sound absorbing member is attached. In short, the invention may be embodied such that the front face of the baffle plate 14 may be divided into a first region (i.e., a region providing a baffle surface parallel to the sound emission surface of the sound source) and a second region (i.e., a concave or convex region relative to the baffle surface or a region to which the sound absorbing member is attached), which first and second regions have mutually different reflection characteristics and such that the second region has a width that increases with an increase in a distance from the corresponding speaker unit. This embodiment is conceptually represented as follows: "a speaker comprising: a casing having a baffle plate; and a sound source fixed to the baffle plate of the casing, wherein a first region and a second region having mutually different reflection characteristics are formed on the baffle plate, wherein the sound source is disposed in the first region, and wherein the second region has a width that increases with an increase in a distance from the sound source". One example of this arrangement is the six embodiment illustrated above.

(6) In the first through six embodiments, the height dimension H, the width dimension W, and the depth dimension L of the enclosure 10 is H=1000 mm, W=520 mm, and L=480 mm, respectively. The height dimension H, the width dimension W, and the depth dimension L of the enclosure 10 may be made different from those in the illustrated embodiments.

Figure 10A:
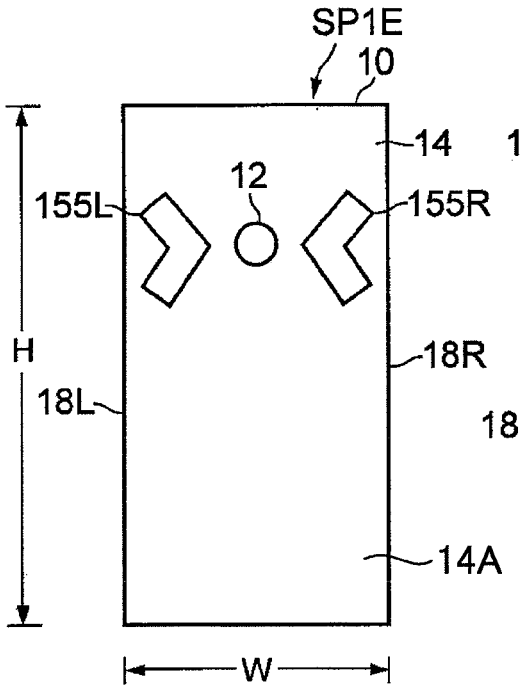
FIG. 10A is a front view and FIG. 10B is a side view of a speaker according to a modified example of the invention.
Figure 10B:
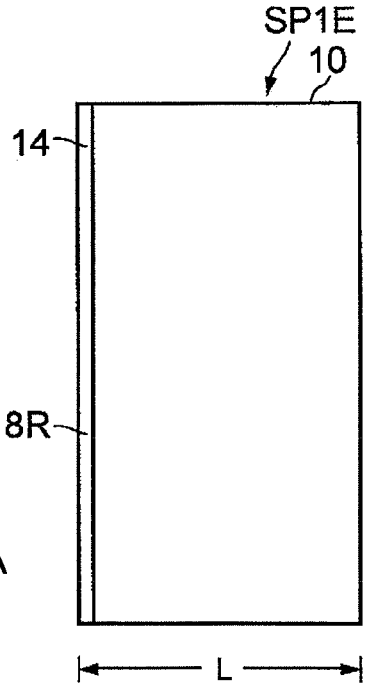

(7) In the illustrated fourth embodiment, the cutouts 154L, 154R formed in the baffle plate 14 have the crescent-like shape. The cutouts 154L, 154R may not necessarily have the crescent-like shape as long as the cutouts 154L, 154R have the configuration in which the width increases with an increase in the distance from the speaker unit 12. FIG. 10A is a front view of a speaker SP1E according to a modified example. FIG. 10B is a right side view of the speaker SP1E. Each of cutouts 155L, 155R formed in the baffle plate 14 of the speaker SP1E is bent so as to have a doglegged shape or a "V"-letter shape, as shown in FIG. 10A. The bent portion of the cutout 155L and the bent portion of the cutout 155R are oriented toward the speaker unit 12. The thus structured speaker unit SP1E also offers advantageous effects similar to those offered by the speakers according to the illustrated embodiments.

What is claimed is:

1. A speaker, comprising:

a casing having a baffle plate; and a sound source fixed to the baffle plate of the casing, wherein at least one cutout is formed in the baffle plate, the at least one cutout having a configuration in which a length of the at least one cutout increases with an increase in a distance from the sound source, wherein the length of the at least one cutout is a size of the at least one cutout in a first direction perpendicular to a second direction, the second direction being a direction directed from a center of the sound source to one of apexes of the at least one cutout that is the nearest to the sound source, and wherein the at least one cutout reaches an end of the baffle plate, and the length of the at least one cutout in the first direction is maximum at the end of the baffle plate.

2. The speaker according to claim 1, wherein the at least one cutout has a triangular shape in which the one of three apexes of the triangular shape is oriented toward the sound source.

3. A speaker, comprising:

a casing having a baffle plate; and a sound source fixed to the baffle plate of the casing, wherein a first region and a second region having mutually different reflection characteristics are formed on the baffle plate, wherein the sound source is disposed in the first region, and wherein the second region has a length that increases with an increase in a distance from the sound source, wherein the length of the second region is a size of the second region in a first direction perpendicular to a second direction, the second direction being a direction directed from a center of the sound source to one of apexes of the second region that is nearest to the sound source, and wherein the second region reaches an end of the baffle plate, and the length of the second region in the first direction is maximum at the end of the baffle plate.

* * * * *